US005984749A

United States Patent [19]

Nishibori et al.

[11] Patent Number: 5,984,749

[45] **Date of Patent: *Nov. 16, 1999**

[54] METHOD OF SEALING A LAMP

[76] Inventors: Yumiko Nishibori; Mari Nishibori, both of 3-4, Meguro 1-chome, Meguro-ku, Tokyo, 153, Japan

[ * ] Notice: This patent is subject to a terminal disclaimer.

[21] Appl. No.: 08/923,541

[22] Filed: Sep. 4, 1997

[30] Foreign Application Priority Data

Sep. 18, 1996 [JP] Japan ..... 8-269198

[51] Int. Cl.[6] ..... H01J 27/08

[52] U.S. Cl. ..... 445/26; 445/27

[58] Field of Search ..... 445/26, 27

[56] References Cited

U.S. PATENT DOCUMENTS 5,037,342 8/1991 Barthelmes et al. ..... 445/22
5,108,333 4/1992 Heider et al. ..... 445/26
5,209,689 5/1993 Griffin et al. ..... 445/27

*Primary Examiner*—Kenneth J. Ramsey
*Assistant Examiner*—Gene H. Rhodes
*Attorney, Agent, or Firm*—Oblon, Spivak,McClelland, Maier & Neustadt, P.C.

[57] ABSTRACT

A method of sealing a lamp includes: providing a lamp envelop having an envelop body, and first and second end portions which are open; inserting a mount including a filament and a resilient retainer into the lamp envelop through one of the open end portions until the mount is retained within the lamp envelop by the resilient retainer; heating the first open end portion of the lamp envelop to soften and shrink and then optionally pinching the heated portion thereby sealing the first open end portion with one end of the mount embedded therein; and heating the second open end portion of the lamp envelop to soften and shrink and then optionally pinching the heated portion thereby sealing the second open end portion with an opposite end of the mount embedded therein.

12 Claims, 26 Drawing Sheets

A(A2)
1a
3
G
19
10
1
D
1H
K
20
8
d
21a
1d
13

METHOD OF SEALING A LAMP

BACKGROUND OF THE INVENTION

1. Field of the Invention

The present invention relates to a method of sealing lamps such as tipless halogen lamps or tipless metal halide lamps without using a tip tube.

2. Description of the Prior Art

FIG. 26 shows a conventional halogen lamp (B') having a typical configuration wherein sealing foils (10') are respectively embedded in seal portions (13') of a lamp envelop (1'), and one end of each sealing foil (10') is welded to a lead portion (21') of a filament (6'), while the other end thereof is welded to a corresponding outer lead pin (11') extending to project outwardly from the seal portion (13').

It has been a conventional practice to seal this type halogen lamps in the following manner. As shown in FIG. 25, an upper open end of a lamp envelop (1') is closed by a lid (30') and an outer lead pin (11') is fixed using a clip (31'). Then, an non-oxidizing gas such as nitrogen, argon, or a mixture of such gas with hydrogen is supplied through a gas supply tube (20') connected to a tip tube (29') into the lamp envelop (1') and discharged from a lower end of the lamp envelop (1') to keep the inside of the lamp envelop (1') in a non-oxidizing atmosphere. In this state, the lower end portion of the lamp envelop (1') is heated so as to be softened, and the end thus softened is pinch-sealed. Subsequently, the lamp envelop (1') is turned upside down, and the same operations as above are repeated, thereby sealing opposite ends of the lamp envelop (1'). Then, the gas within the lamp envelop (1') is sucked out through the tip tube (29') connected to the lamp envelop (1') to provide a high vacuum in the lamp envelop (1'). After necessary operations such as washing by a non-oxidizing gas are completed, the lamp envelop (1') is filled with a required gas, and finally the tip tube (29') is cut-sealed at the base portion thereof by heating.

However, such use of tip tube (29') results in a cut-sealed trace (30') of the tip tube (29') formed on a side surface of the lamp envelop, which not only renders the appearance of the lamp poor but also causes an internal strain to be left in peripheral portions thereof, thereby decreasing the pressure resistance of the lamp envelop (1'). Repeating on/off operations of the lamp i.e., repeating heating and cooling of the lamp may eventually cause the lamp envelop to be broken from the cut-sealed trace (30').

Recently, halogen lamps adaptable for commercial voltages of less power consumption have been demanded in many countries. In response thereto, the volume of a lamp envelop can not help being decreased. However, if a tip tube is used in such a lamp envelop of a decreased volume, the lamp envelop can not be sufficiently cooled when it is immersed in liquid nitrogen for cutting the tip tube after a required gas is filled therein, because liquid nitrogen vaporizes due to the heat of a tip-off burner. As a result, the amount of the filling gas becomes insufficient and, hence, sufficient pressurizing of the lamp envelop can not be achieved. Thus, in spite of the recent tendency to increase the pressure of the gas to be filled in the lamp envelop so as to enhance the performance of the lamp such as a brightness and lifetime, the use of a tip tube makes it impossible to increase the filling gas pressure for such a small volume lamp envelop because of the reasons stated above. Further, the presence of the cut-sealed trace of the tip tube causes an internal strain to be left adjacent the trace and, hence, the lamp envelop can not endure such a high filling gas pressure.

Consequently, it has been difficult to significantly enhance the performance of a small-sized halogen lamp of the type using a tip tube.

There exists another problem that the cut-sealed trace of the tip tube causes the scattering of light passing through the trace and the peripheral portion thereof, which leads to a decreased light-converging ability. Such a lamp is not suitable for use as a light source of high-precision apparatus such as a microscope or a measuring instrument. This is also true for the case of a metal halide lamp.

It is, therefore, an object of the present invention to provide a novel method of sealing a lamp such as a halogen lamp or a metal halide lamp, with which: a conventionally required tip tube can be dispensed with thereby providing a lamp envelop free of a cut-sealed trace; and the filling gas pressure can be increased.

SUMMARY OF THE INVENTION

In accordance with a first aspect of the present invention, there is provided a method of sealing a tipless halogen lamp comprising the steps of: providing a lamp envelop having an envelop body, and first and second end portions which are open; inserting a mount including a filament and a resilient retainer into the lamp envelop through one of the open end portions until the mount is retained within the lamp envelop by the resilient retainer; heating the first open end portion of the lamp envelop to soften and shrink and then optionally pinching the heated portion thereby sealing the first open end portion with one end of the mount embedded therein; and heating the second open end portion of the lamp envelop to soften and shrink and then optionally pinching the heated portion thereby sealing the second open end portion with an opposite end of the mount embedded therein.

In accordance with a second aspect of the present invention, there is provided a method of sealing a tipless halogen lamp comprising the steps of: providing a lamp envelop having an envelop body, and first and second end portions which are open; inserting a mount including a filament and a resilient retainer into the lamp envelop through one of the open end portions until the mount is retained within the lamp envelop by the resilient retainer; and heating simultaneously the first and second open end portions of the lamp envelop to soften and shrink and then optionally pinching the heated portions thereby simultaneously sealing the first and second open end portions with opposite ends of the mount embedded in the first and second end portions, respectively.

With these methods, irrespective of whether opposite end portions of the lamp envelop are sealed successively or simultaneously, the mount M is retained within the lamp envelop by means of the resilient retainer 3 and, hence, a required gas can be fed into the lamp envelop from one of the open end portions. As a result, it is possible to seal the lamp envelop without using a conventionally required tip tube, thereby providing a lamp envelop free of a cut-sealed trace of the tip tube.

When opposite end portions of the lamp envelop are sealed successively, the former sealing method can be carried out with almost entire portion of the lamp envelop being cooled as shown in FIG. 2. On the other hand, when opposite end portions of the lamp envelop are sealed simultaneously according to the latter method, the pressurizing of the lamp envelop requires a particular device as shown in FIG. 22. Specifically, a pair of appropriately spaced shielding plates are placed adjacent the central portion of the lamp envelop for applying liquid nitrogen to the lamp envelop between the plates. After the volume of the required gas within the lamp envelop is thus reduced, the sealing is carried out.

The opposite end portions of the lamp envelop may be formed narrower than the envelop body as shown in FIG. 1, or one end portion may be formed narrower than the envelop body while the other end portion may be formed to have the same width as that of the envelop body as shown in FIG. 4, or one end portion may be formed narrower than the envelop body and the other end portion may comprise a portion formed narrower than the envelop body and the rest having the same width as that of the envelop body as shown in FIG. 5. Alternatively, the opposite end portions may be formed to have the same width as that of the lamp envelop body as shown in FIG. 6.

Combinations of various shapes of open end portions shown in FIGS. 7 to 12 are typically employed for manufacturing lamps in accordance with the present invention. This is also true for the case of metal halide lamps.

In accordance with a third aspect of the present invention, there is provided a method of sealing a tipless metal halide lamp comprising the steps of: providing a lamp envelop having an envelop body, and first and second end portions which are open; inserting a first discharge electrode into the lamp envelop through the first open end portion and retaining the first discharge electrode within the lamp envelop; heating the first open end portion of the lamp envelop to soften and shrink and then optionally pinching the heated portion thereby sealing the first open end portion with a portion of the first discharge electrode embedded therein; inserting a second discharge electrode into the lamp envelop through the second open end portion and retaining the second discharge electrode within the lamp envelop; and heating the second open end portion of the lamp envelop to soften and shrink and then optionally pinching the heated portion thereby sealing the second open end portion with a portion of the second discharge electrode embedded therein; at least one of the first and second discharge electrodes being provided with a resilient retainer for retaining the corresponding discharge electrode within the lamp envelop.

These steps are shown in FIG. 20 and follows the procedure indicated by the arrow drawn from FIG. 20 (*a*) to FIG. 20 (*d*) or the arrow drawn from FIG. 20 (*a*') to FIG. 20 (*d*).

In accordance with a fourth aspect of the present invention, there is provided a method of sealing a tipless metal halide lamp comprising the steps of: providing a lamp envelop having an envelop body, and first and second end portions which are open; inserting first and second discharge electrodes at least one of which is provided with a resilient retainer into the lamp envelop through the first and second open end portions, respectively, and retaining the first and second discharge electrodes within the lamp envelop; heating the first open end portion of the lamp envelop to soften and shrink and then optionally pinching the heated portion thereby sealing the first open end portion with a portion of the first discharge electrode embedded therein; and heating the second open end portion of the lamp envelop to soften and shrink and then optionally pinching the heated portion thereby sealing the second open end portion with a portion of the second discharge electrode embedded therein.

These steps are shown in FIG. 21 and follows the procedure indicated by the arrow drawn from FIG. 21 (*a*) to FIG. 21 (*c*) or the arrow drawn from FIG. 21 (*a*') to FIG. 21 (*c*).

In accordance with a fifth aspect of the present invention, there is provided a method of sealing a tipless metal halide lamp comprising the steps of: providing a lamp envelop having an envelop body, and first and second end portions which are open; inserting first and second discharge electrodes at least one of which is provided with a resilient retainer into the lamp envelop through the first and second open end portions, respectively, and retaining the first and second discharge electrodes within the lamp envelop; and heating simultaneously the first and second open end portions of the lamp envelop to soften and shrink and then optionally pinching the heated portions thereby simultaneously sealing the first and second open end portions with the first and second discharge electrodes partially embedded in the first and second end portions thus sealed, respectively.

These steps are shown in FIG. 21 and follows the procedure indicated by the broken line arrow drawn from FIG. 21 (*a*) to FIG. 21 (*c*) or the broken line arrow drawn from FIG. 21 (*a*') to FIG. 21 (*c*).

In each of the methods according to the third to fifth aspects of the present invention, the resilient retainer may be attached to each of the opposite discharge electrodes or to only one discharge electrode. A non-oxidizing gas or a required gas is fed into the lamp envelop through one of the open end portions.

When sealing the lamp envelop, it may be oriented horizontally, vertically, or in any other direction.

In these methods of sealing a metal halide lamp, as in the methods of sealing a halogen lamp, at least one of the discharge electrodes is retained within the lamp envelop by the resilient retainer 3 and, hence, a required gas can be fed into the lamp envelop through the open end portion on the resilient retainer side. As a result, it is possible to seal a lamp envelop without using a conventionally required tip tube, thereby providing a lamp envelop free of a conventionally inevitable cut-sealed trace of the tip tube.

In the methods of the present invention, it is preferable that at least one of the first and second open end portions of the lamp envelop is narrower than the envelop body and the mount or the opposite discharge electrodes are inserted into the lamp envelop in such a manner that the opposite ends of the mount or the outer ends of the discharge electrodes are positioned in the first and second end portions, respectively, of the lamp envelop. With this method, when both end portions of the lamp envelop are formed narrower, opposite ends of the mount or the outer ends of the opposite discharge electrodes are disposed within the opposite narrower end portions, respectively, of the lamp envelop. Thus, the mount or the discharge electrodes can be located centrally of the lamp envelop by a resilient retainer provided at a portion of the mount or the discharge electrodes, whereby the mount is easily aligned on the central axis of the lamp envelop by mere insertion.

In the methods of the present invention, it is also preferable that at least one of the first and second open end portions of the lamp envelop comprises a narrow portion which is equal to or smaller in width than the envelop body, and a wide portion which is wider than the narrow portion and is formed contiguous to the narrow portion, the narrow portion being intended to be heated to form a seal portion.

In this method, when the gas supply tube is connected to the wide portion and the narrow portion is heated for sealing the open end portion, the existence of the wide portion hinders flame of the burner from reaching the gas supply tube, and thus, the gas supply tube can be protected by the wide portion. As a result, the distance between the lower end of the gas supply tube and the upper end of the envelop body can be shortened, which lead to a decreased cost of making a lamp.

The foregoing and other objects, features and attendant advantages will become readily apparent from the reading of the following detailed description of the invention in conjunction with the attached drawings.

BRIEF DESCRIPTION OF THE DRAWINGS

FIG. 20 illustrates a first embodiment of a method of sealing a metal halide lamp according to the present invention, in which: FIG. 20 (*a*) is partially-sectional elevational view illustrating a first step in which a discharge electrode without a resilient retainer is inserted into a lamp envelop from one open end portion; FIG. 20 (*a*') is partially-sectional elevational view illustrating another first step in which a discharge electrode provided with a resilient retainer is inserted into the lamp envelop from the open end portion; FIG. 20 (*b*) is partially-sectional elevational view illustrating a second step in which the open end portion is sealed; FIG. 20 (*c*) is partially-sectional elevational view illustrating a third step in which a counter discharge electrode provided with a resilient retainer is inserted into a lamp envelop through the opposite open end portion and heated at that open end portion; and FIG. 20 (*d*) is partially-sectional elevational view illustrating a fourth step in which the opposite open end portion is sealed to complete the metal halide lamp;

FIG. 21 illustrates a second embodiment of a method of sealing a metal halide lamp according to the present invention, in which: FIG. 21 (*a*) is partially-sectional elevational view illustrating a first step in which a discharge electrode provided with a resilient retainer and a counter discharge electrode without a resilient retainer are simultaneously inserted into a lamp envelop through respective open end portions; FIG. 21 (*a*') is partially-sectional elevational view illustrating another first step in which opposite discharge electrodes each provided with a resilient retainer are inserted into a lamp envelop through respective open end portions simultaneously; FIG. 21 (*b*) is partially-sectional elevational view illustrating a second step in which one open end portion is sealed while the opposite open end portion is heated; and FIG. 21 (*c*) is partially-sectional elevational view illustrating a third step in which the opposite open end portion is sealed to complete the metal halide lamp;

DETAILED DESCRIPTION OF THE PREFERRED EMBODIMENTS

The present invention will now be described in detail with reference to the accompanying drawings. The present invention can be applied to lamps such as halogen lamps (A1) and metal halide lamps (A2). Firstly, a method of sealing a halogen lamp will be described below.

Figure 3:
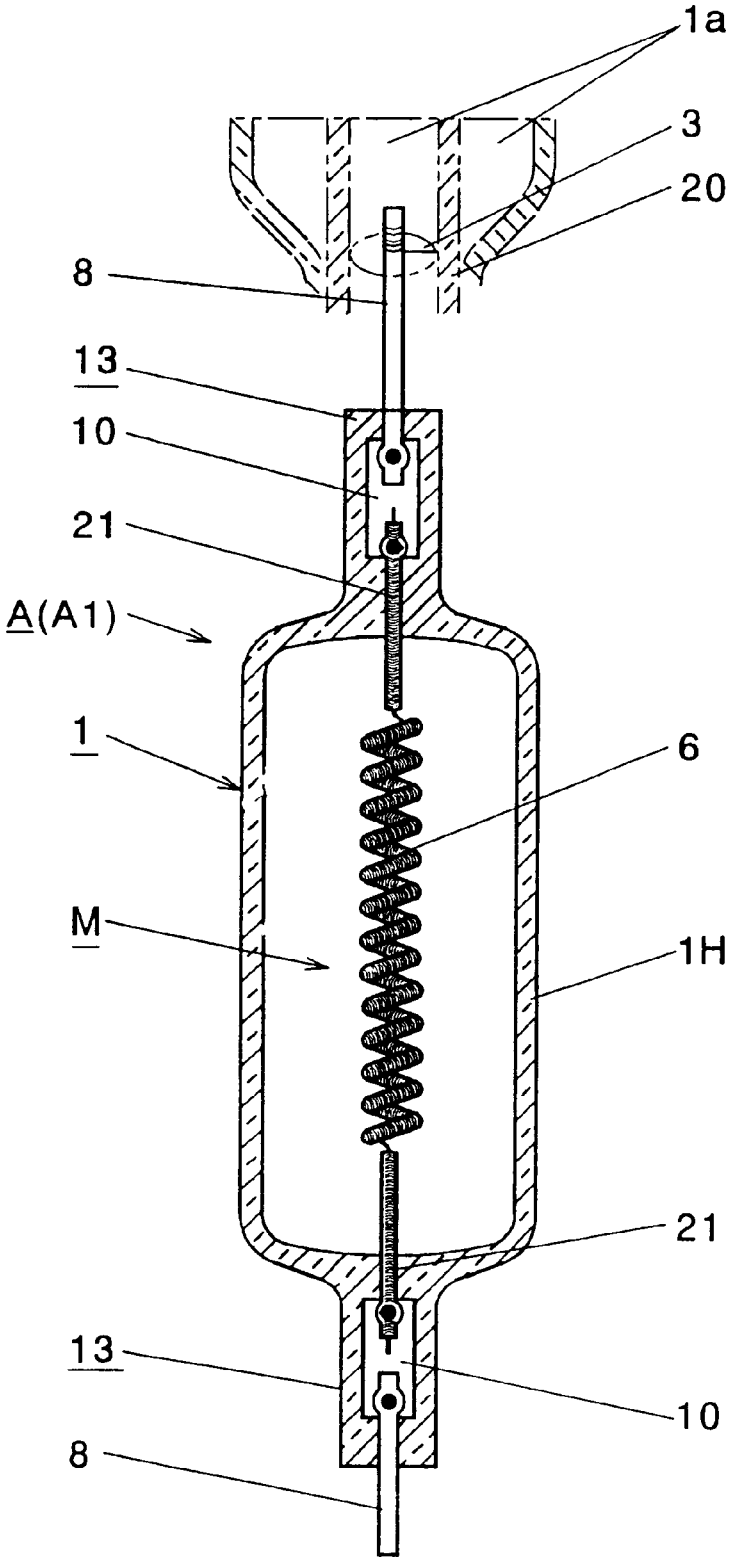
FIG. 3 is a partially-sectional elevational view illustrating a double-ended type halogen lamp according to the present invention in a state where opposite ends of the lamp envelop shown in FIG. 1 are sealed.

Referring to FIG. 3, a halogen lamp (A1) in accordance with the present invention is of a double-ended type having seal portions 13 formed at opposite ends of a lamp envelop 1 of quartz glass, and a filament 6 extending in an envelop body 1H. The filament 6 is of a double coil type of tungsten including at opposite ends thereof, lead portions 21 formed by covering a single coil with another coil, and the outer end of each lead portion 21 is welded to the inner end of each sealing foil 10. At least one support member (not shown) in the form of a vortex may be disposed to wind around an appropriate portion of the filament 6 so that a portion of the outer circumference of the vortex is fixedly embedded in a support fixing portion of the lamp envelop 1 formed by indenting the lamp envelop 1.

The configuration of each lead portion 21 is not limited to that described above. That is, lead portion 21 may comprise a single coil portion of filament 6 directly welded to sealing foil 10, or connected to the sealing foil 10 through an inner lead pin (not shown).

The sealing foils 10 are each typically formed of thin molybdenum foil having a thickness of from 20 to 30 $\mu$m. Each sealing foil is partially or wholly embedded in each seal portion 13, and the outer end of each sealing foil 10 is welded to an outer lead pin 8 outwardly projecting from the corresponding seal portion 13. The sealing foils 10 may extend outwardly from the respective seal portions 13, and in that case, the outer lead pins 8 can be dispensed with.

Mount M comprises the filament 6, the lead portions 21 connected to opposite ends of the filament 6 directly or through inner lead pins, the sealing foils 10 respectively welded to the outer ends of the lead portions 21, and the outer lead pins 8 respectively welded to the outer ends of the sealing foils 10. The outer lead pins 8 are not necessary where the sealing foils 10 extend outwardly from the respective seal portions 13.

Another form of mount M is of a sealing foil free type wherein opposite ends of filament 6 are respectively connected to outer lead pins 8 directly or through lead portions 21.

In either form of mount M, a separate resilient retainer 3 is attached to a portion of mount M, or a portion of mount M is bent to form an integral resilient retainer 3.

Exemplary combinations of elements constituting mount M are as follows:

1. filament 6, lead portions 21, sealing foils 10, and outer lead pins 8
2. filament 6, lead portions 21, and sealing foils 10
3. filament 6, sealing foils 10, and outer lead pins 8
4. filament 6, lead portions 21, and outer lead pins 8
5. filament 6 and sealing foils 10
6. filament 6 and outer lead pins 8

Examples of mount M are illustrated in FIGS. 14 to 19 and explanation thereof will be given below. Resilient retainer 3 resiliently engages an inner circumferential surface of lamp envelop 1 when the mount M is inserted into the lamp envelop 1, thereby suspending the mount M centrally of the lamp envelop 1. Where the resilient retainer 3 is a separate member, it may be formed of, for example, a thin stainless steel wire.

Figures 14A, 14B, 14C, 14D, 14E, 14F:
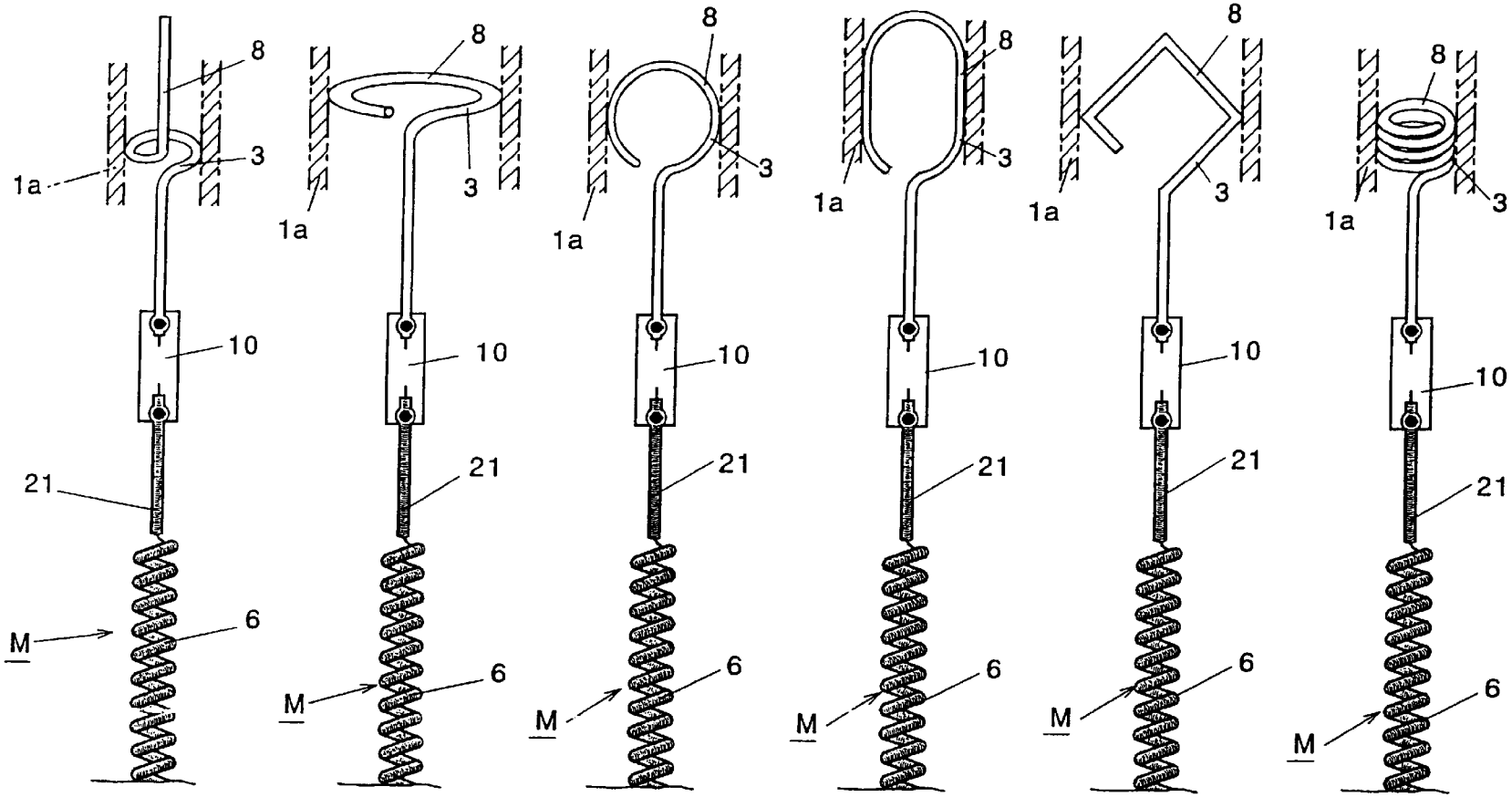
FIGS. 14 (*a*) to 14 (*f*) are each a fragmentary front elevational view illustrating a mount including a sealing foil and a bent outer lead pin according to the present invention.

FIGS. 14 (*a*) to 14 (*f*) illustrate exemplary variations of mount M having sealing foil 10 in each of which resilient retainer 3 is formed by bending a portion of outer lead pin 8. The resilient retainer 3 may be in the form of a single ring as shown in FIG. 14 (*a*), or a ring formed at the end of the outer lead pin 8 and extending perpendicular to the outer lead pin 8 as shown in FIG. 14 (*b*), or a ring formed at the end of the outer lead pin 8 and extending parallel to the outer lead pin 8 as shown in FIG. 14 (*c*), or an elliptical hook as shown in FIG. 14 (*d*), or a rectangular hook as shown in FIG. 14 (*e*), or a spiral coil as shown in FIG. 14 (*f*).

Figures 15A, 15B, 15C, 15D, 15E, 15F:
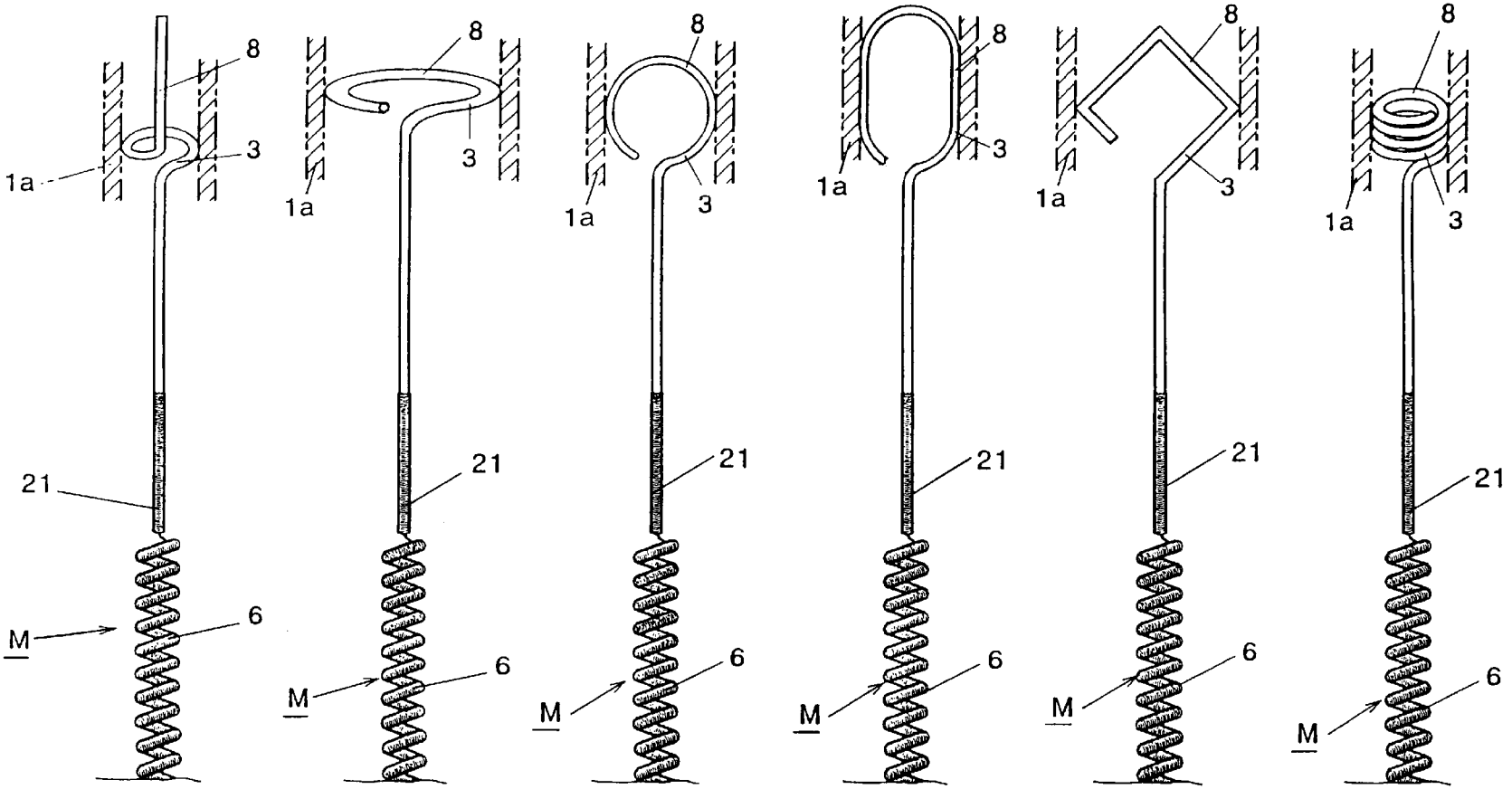
FIGS. 15 (*a*) to 15 (*f*) are each a fragmentary front elevational view illustrating a sealing foil free mount having a bent outer lead pin according to the present invention.

FIGS. 15 (*a*) to 15 (*f*) illustrate exemplary variations of mount M not having sealing foil 10 which correspond to those shown in FIGS. 14 (*a*) to 14 (*f*).

Figures 16A, 16B, 16C, 16D, 16E:
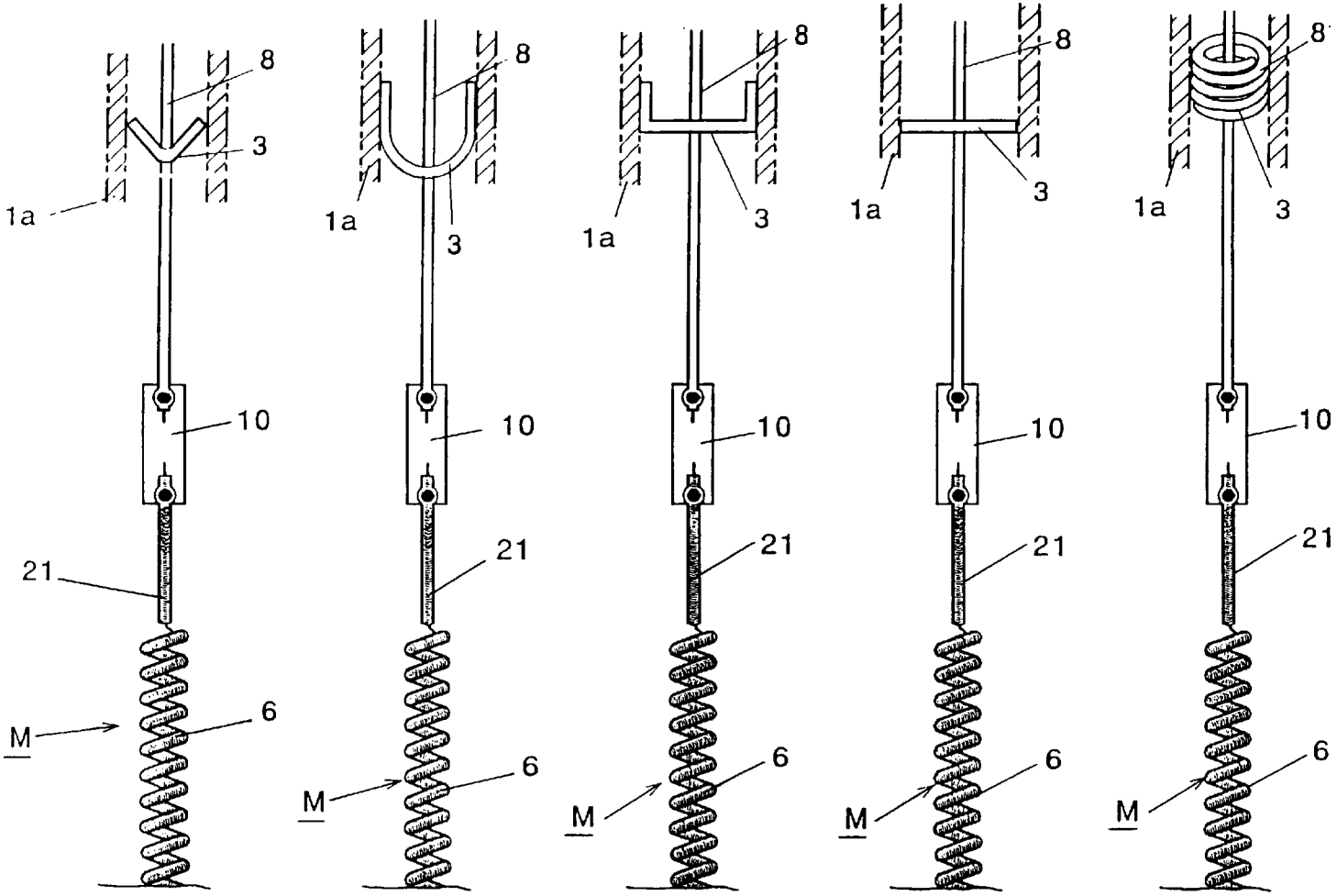
FIGS. 16 (*a*) to 16 (*e*) are each a fragmentary front elevational view illustrating a mount including a sealing foil and using a separate resilient retainer attached to the mount according to the present invention.

FIGS. 16 (*a*) to 16 (*e*) show exemplary variations of mount M each having outer lead pin 8 attached with separate resilient retainer 3. The resilient retainer 3 may be V-shaped as shown in FIG. 16 (*a*), or U-shaped as shown in FIG. 16 (*b*), or in the form of a laid "[" as shown in FIG. 16 (*c*), or a horizontal pin as shown in FIG. 16 (*d*), or a spiral coil as shown in FIG. 16 (*e*).

Figures 17A, 17B, 17C, 17D, 17E:
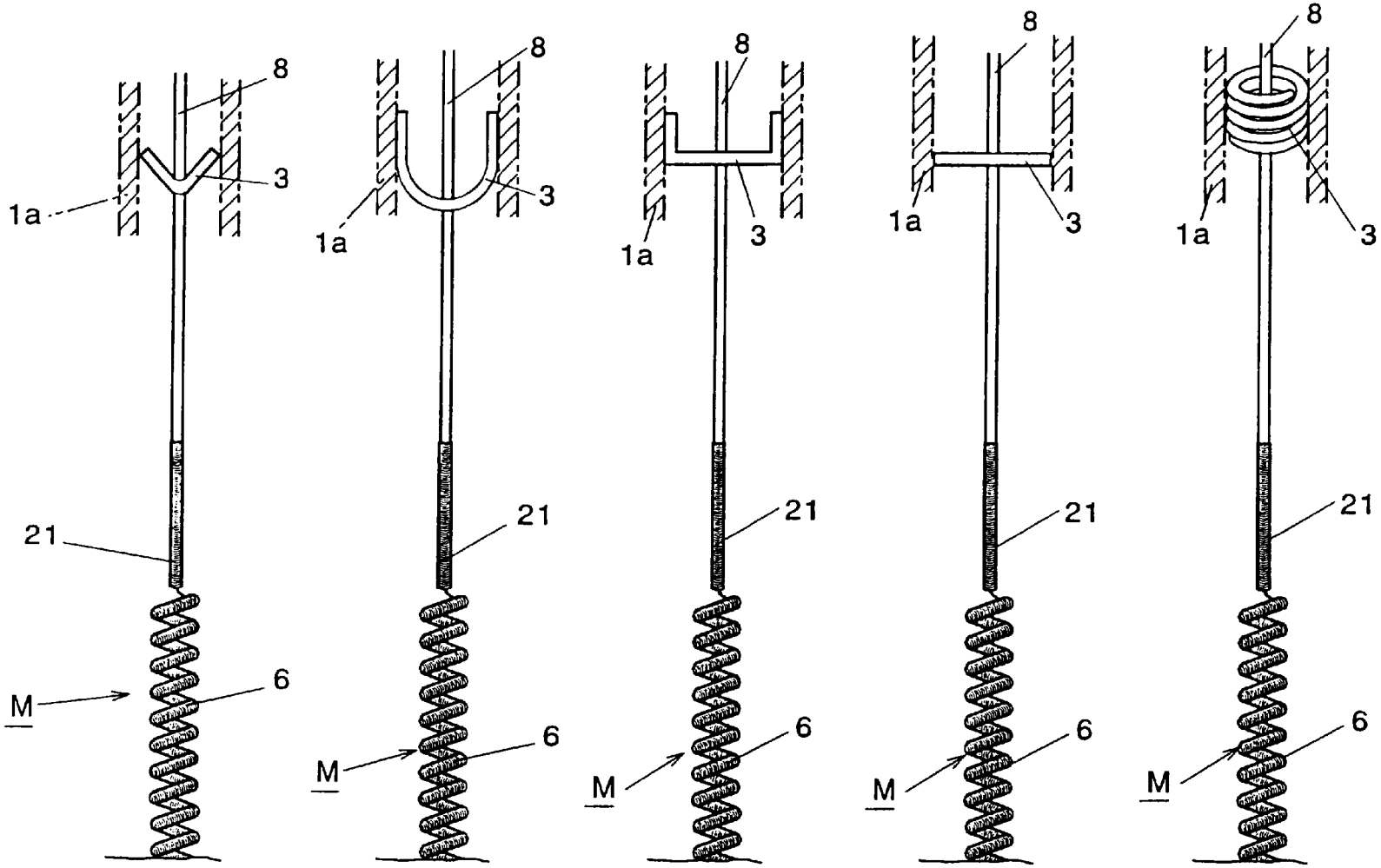
FIGS. 17 (*a*) to (*e*) are each a fragmentary front elevational view illustrating a sealing foil free mount using a separate resilient retainer attached to the mount according to the present invention.

FIGS. 17 (*a*) to 17 (*e*) show exemplary variations of mount M not having sealing foil 10 which correspond to those shown in FIGS. 16 (*a*) to 16 (*e*).

Figures 18A, 18B, 18C, 18D, 18E, 18F:
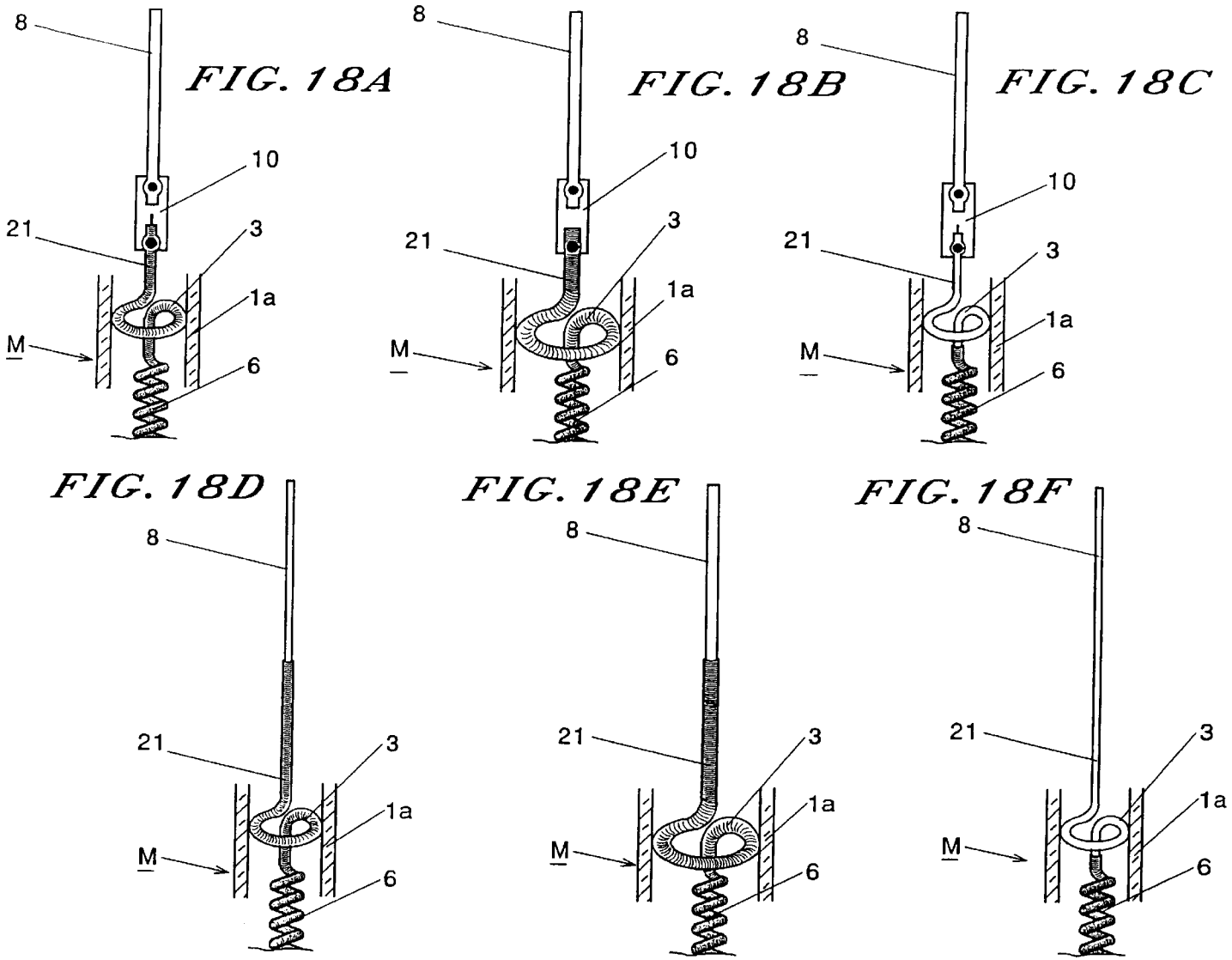
FIGS. 18 (*a*) to (*c*) are each a fragmentary front elevational view illustrating a mount including a sealing foil and a bent outer lead pin according to the present invention, while FIGS. 18 (*d*) to (*f*) are each a fragmentary front elevational view illustrating a sealing foil free mount having a bent outer lead pin according to the present invention.

Referring now to FIGS. 18 (*a*) to 18 (*c*), there are shown variations of mount M having sealing foil 10 in each of which lead portion 21 is bent to serve as resilient retainer portion 3. FIG. 18 (*a*) shows the case where lead portion 21 comprising a single coil portion forming an end portion of filament 6 is bent to form a single ring to serves as resilient retainer portion 3. To reinforce this portion, a molybdenum core wire (not shown) may be provided therein. FIG. 18(*b*) shows the case where an auxiliary coil is wound around an end of filament 6 to serve as lead portion 21 which in turn is formed into resilient retainer portion 3 of a single ring. Shown in FIG. 18 (*c*) is the case where an inner lead pin is attached to filament 6 to serve as lead portion 21 a portion of which is formed into resilient retainer portion 3 of a single ring.

The shape of resilient retainer portion 3 is not limited to those described above, which is true throughout the specification of the present invention.

Shown in FIGS. 18 (*d*) to 18 (*f*) are exemplary variations of mount M not having sealing foil 10 which correspond to those shown in FIGS. 18 (*a*) to 18 (*c*).

Figures 19A, 19B, 19C, 19D:
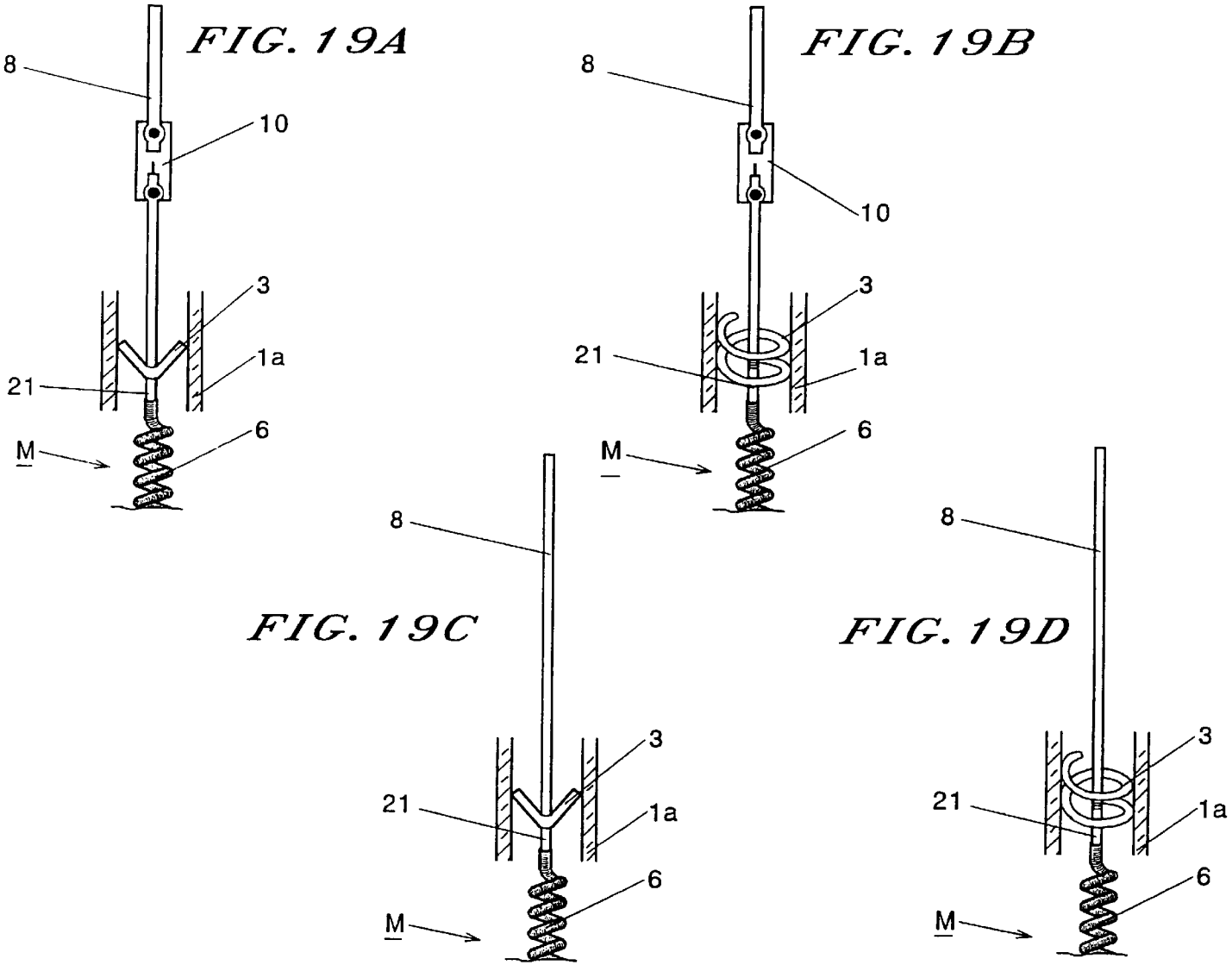
FIGS. 19 (*a*) and 19 (*b*) are each a fragmentary front elevational view illustrating a mount including a sealing foil and using a separate resilient retainer attached to the mount according to the present invention, while FIGS. 19 (*c*) to (*d*) are each a fragmentary front elevational view illustrating a sealing foil free mount using a separate resilient retainer attached to the mount according to the present invention.

Referring to FIGS. 19 (*a*) and 19 (*b*), there are shown variations of mount M having sealing foil 10 in each of which separate resilient retainer 3 is attached to lead portion 21 comprising an inner lead pin. The resilient retainer 3 may be V-shaped as shown in FIG. 19(*a*) or in the form of a spiral coil as shown in FIG. 19(*b*). Similarly to the cases shown in FIGS. 18 (*a*) and 18 (*b*), lead portion 21 may comprise a single coil portion forming an end portion of filament 6 (irrespective of whether or not a molybdenum core wire is provided therein) or an auxiliary coil, and separate resilient retainer 3 of a desired shape may be attached to such lead portion 21.

FIGS. 19 (*c*) and 19 (*d*) show exemplary variations of mount M not having sealing foil 10 which correspond to those shown in FIGS. 19 (*a*) and 19 (*b*).

Although not shown, mount M may be such that sealing foil 10 is made to have a width larger than the inside width of open end portion 1*a* of lamp envelop 1 so as to resiliently engage the inner periphery of the open end portion 1*a* at opposite edges thereof, thereby serving as resilient retainer 3. In this construction, separate resilient retainer 3 is not required and, hence, it is possible to decrease the manufacturing cost and weight of a lamp. This construction is suitable for a lighter mount. It should be noted that any other means for suspending mount M may be employed.

Figure 7:
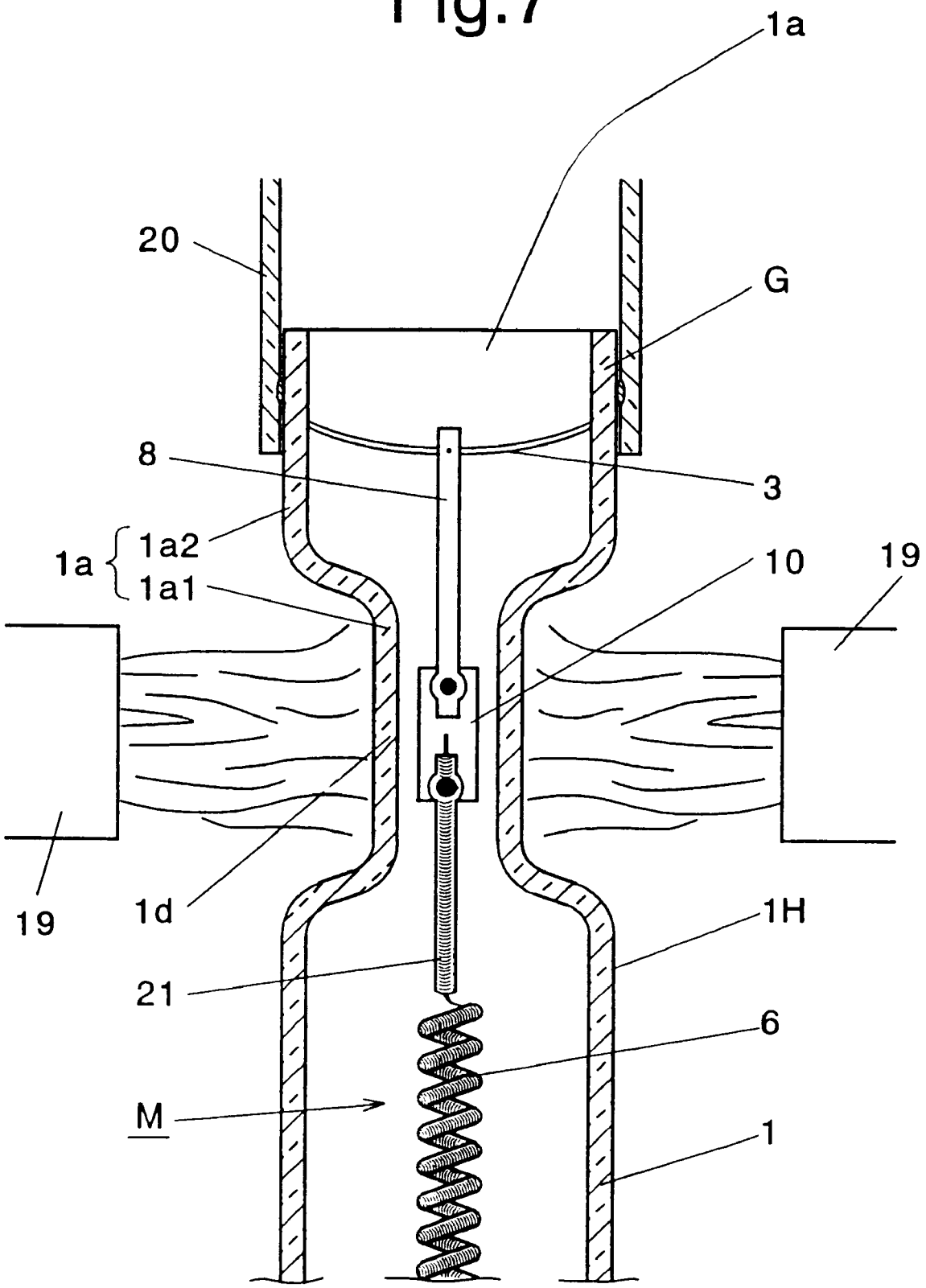
FIG. 7 is a partially-sectional fragmentary elevational view illustrating one step of a method according to the present invention in which a lamp envelop has an open end portion partially formed narrower than the envelop body and is heated at the narrow portion.
Figure 8:
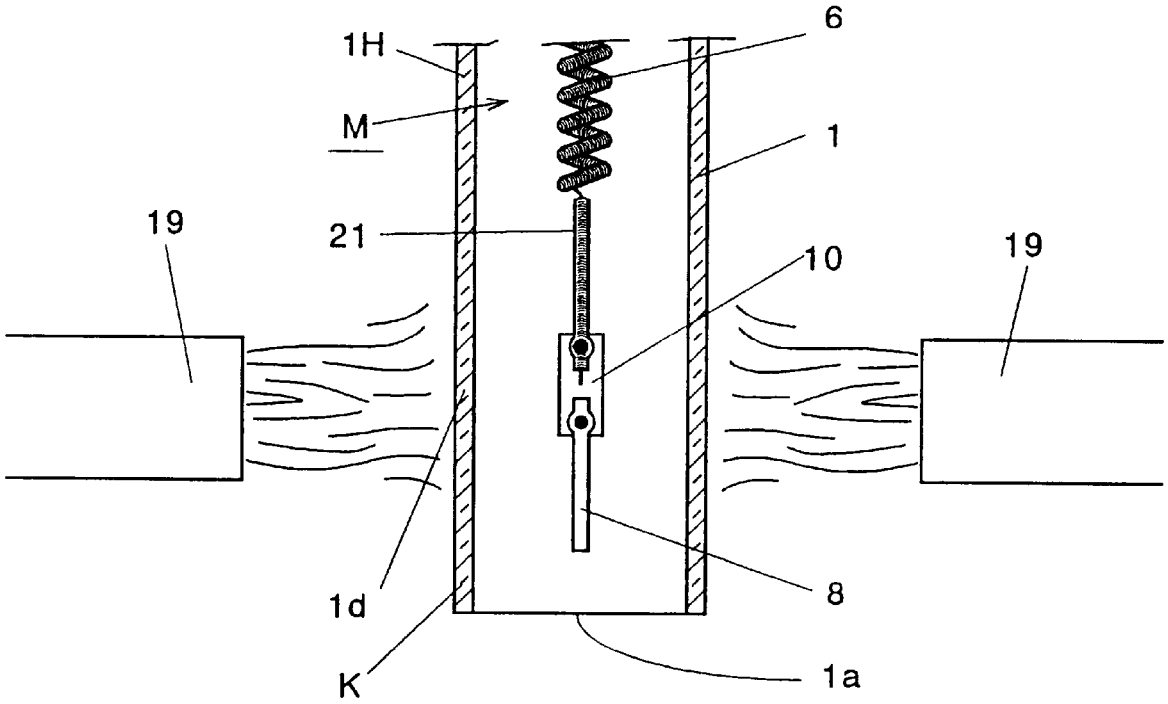
FIG. 8 is a partially-sectional fragmentary elevational view illustrating one step of a method according to the present invention in which a lamp envelop has an lower open end portion formed to have the same width as that of the envelop body and is heated at the lower open end portion.
Figure 9:
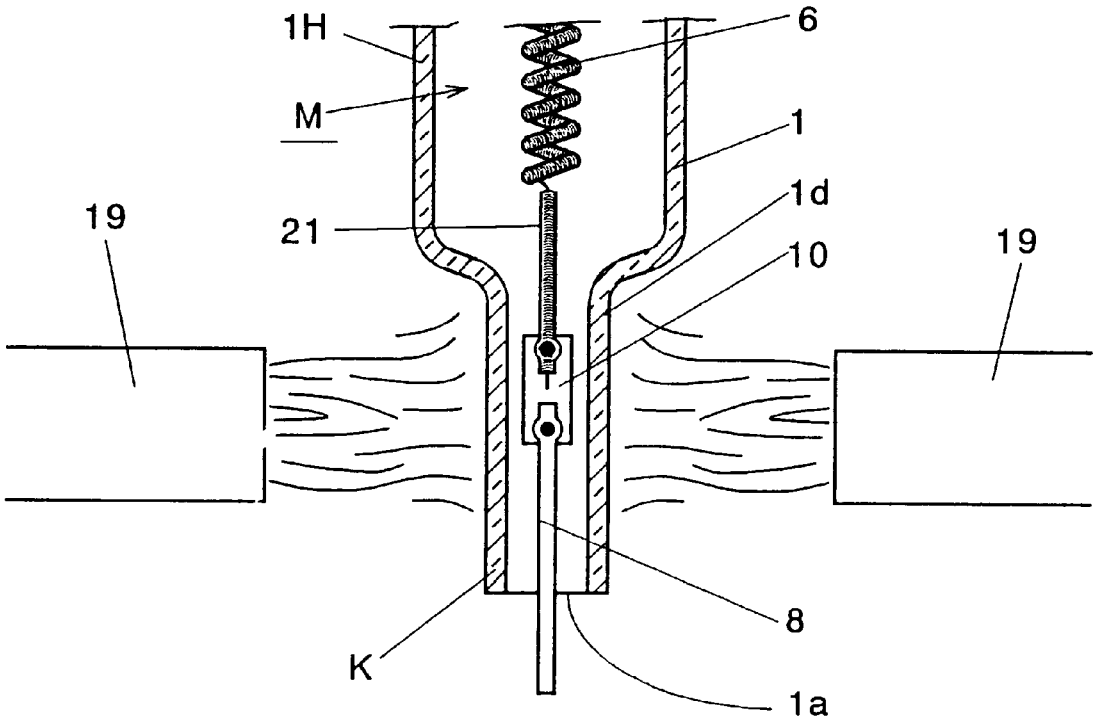
FIG. 9 is a partially-sectional fragmentary elevational view illustrating one step of a method according to the present invention in which a lamp envelop has an lower open end portion formed narrower than the envelop body and is heated at the narrower lower open end portion.
Figure 10:
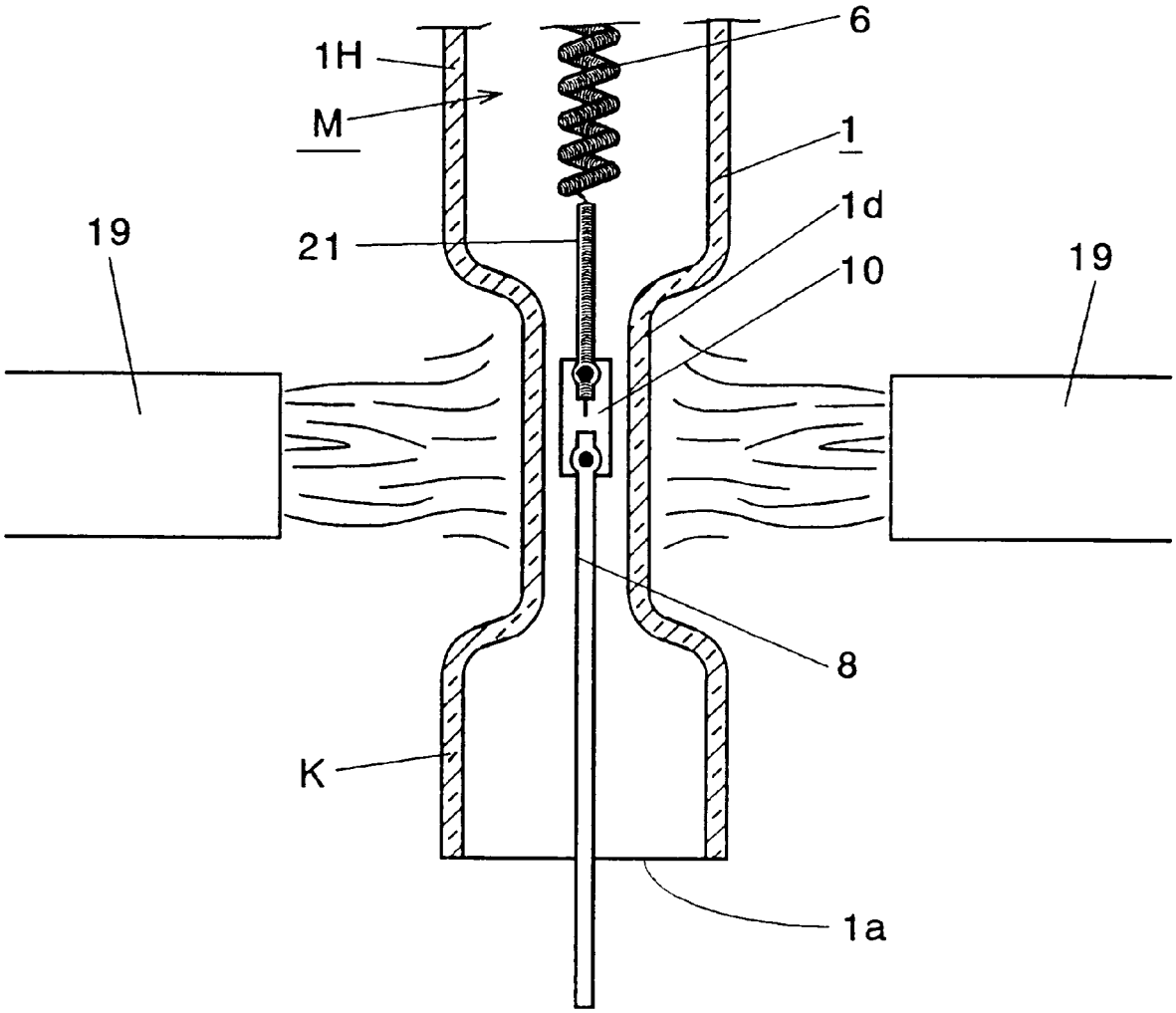
FIG. 10 is a partially-sectional fragmentary elevational view illustrating one step of a method according to the present invention in which a lamp envelop has a lower open end portion partially formed narrower than the envelop body and is heated at the narrow portion.
Figure 11:
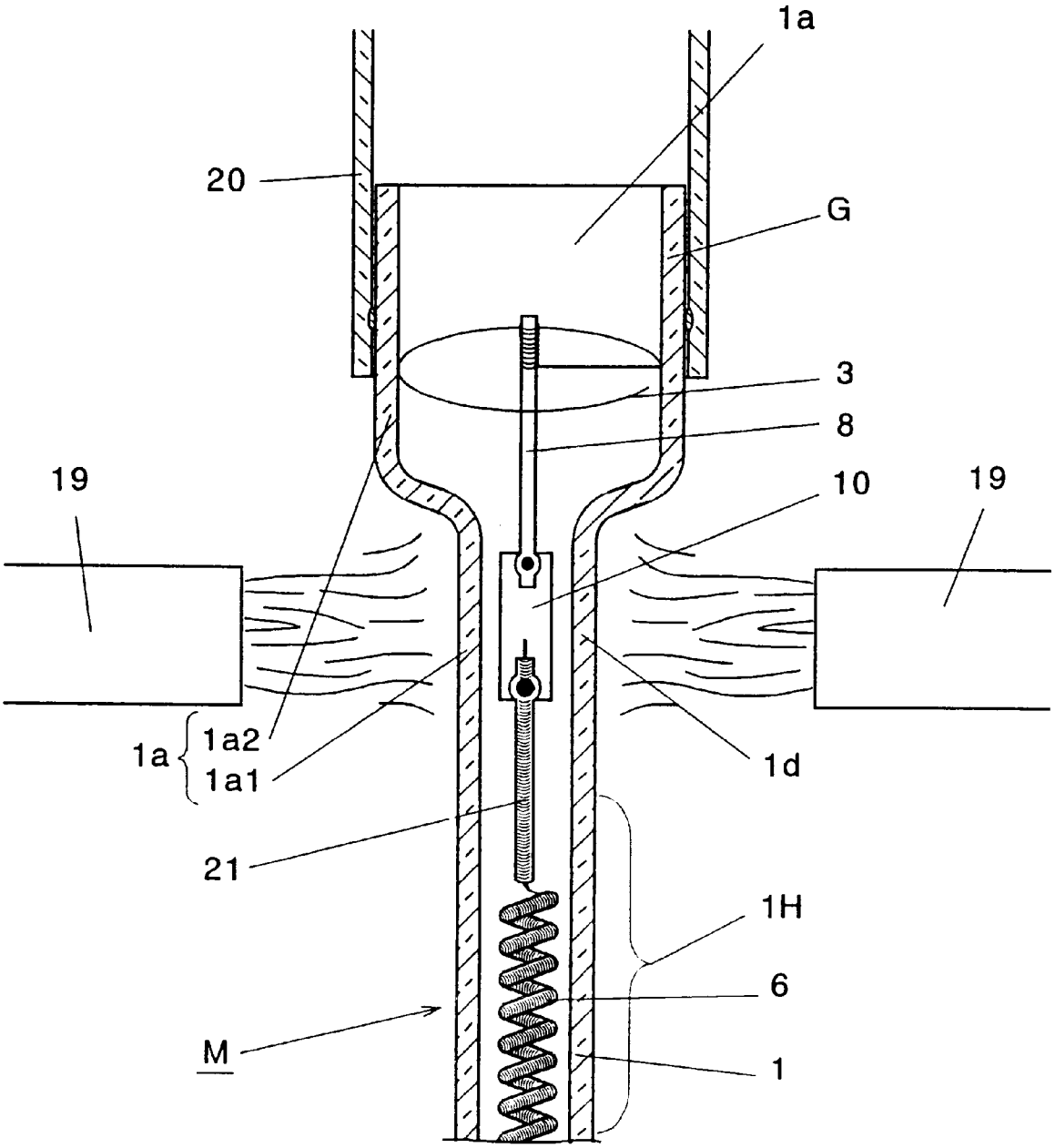
FIG. 11 is a partially-sectional fragmentary elevational view illustrating one step of a method according to the present invention in which a lamp envelop has an open end portion comprising a narrow portion having the same width as that of the envelop body and a wide portion formed wider than the envelop body and is heated at the narrow portion.

The lamp envelop 1 in accordance with the present invention may assume various shapes. FIGS. 7 to 12 each illustrate an open end portion of lamp envelop 1 for introducing a gas therethrough or the opposite open end portion 1*a* for discharging the gas therethrough. The shape of open end portion 1*a* is not limited to those shown in the drawings and any combination of the shapes can be employed. The examples of the shape of the open end portion 1*a* shown are as follows:

1. The open end portion 1*a* is formed to have the same width as that of envelop body 1H as shown in FIG. 8.
2. The open end portion 1*a* is formed narrower than envelop body 1H as shown in FIG. 9.
3. The open end portion 1*a* comprises a narrow portion 1*a*1 having a smaller width than that of envelop body 1H and a wide portion 1*a*2 contiguous to the narrow portion 1*a*1 as shown in FIGS. 7 and 10. That is, only a portion 1*d* to be heated and softened is formed narrower than envelop body 1H.
4. The open end portion 1*a* is formed wider than envelop body 1H as shown in FIG. 11.

Although these drawings illustrate mounts M each including sealing foil 10, mounts M not having the sealing foil 10 can also be employed.

Additionally, although explanation is given to the case where orientation of lamp envelop 1 during the sealing is vertical, the present invention is not limited thereto. That is, any orientation such as horizontal or inclined one may be employed. This is also true for the case of metal halide lamps (A2).

Figure 1:
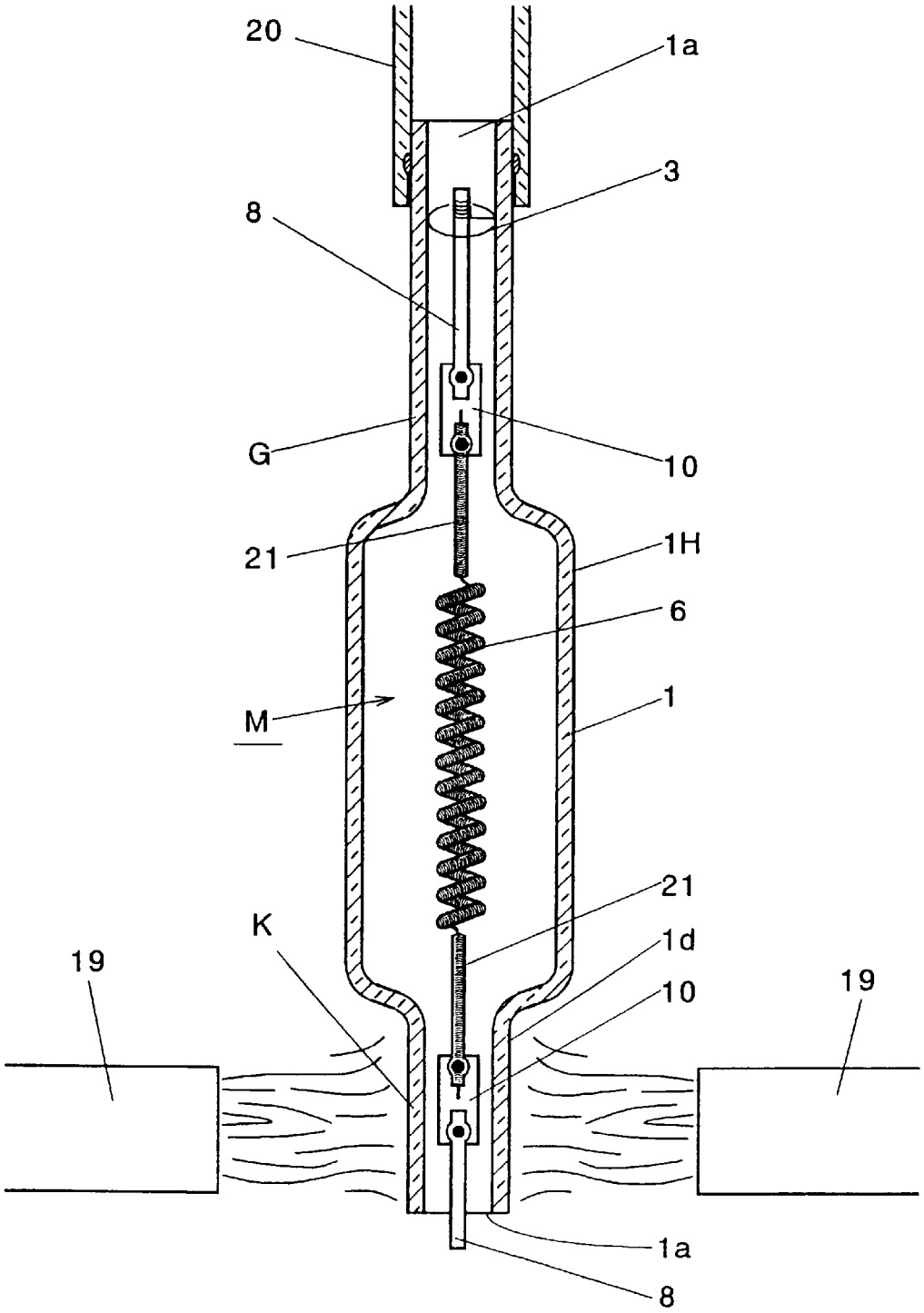
FIG. 1 is a partially-sectional elevational view illustrating one step of a method of sealing a lamp according to the present invention in which a lamp envelop having open opposite end portions is heated at the lower end portion.
Figure 2:
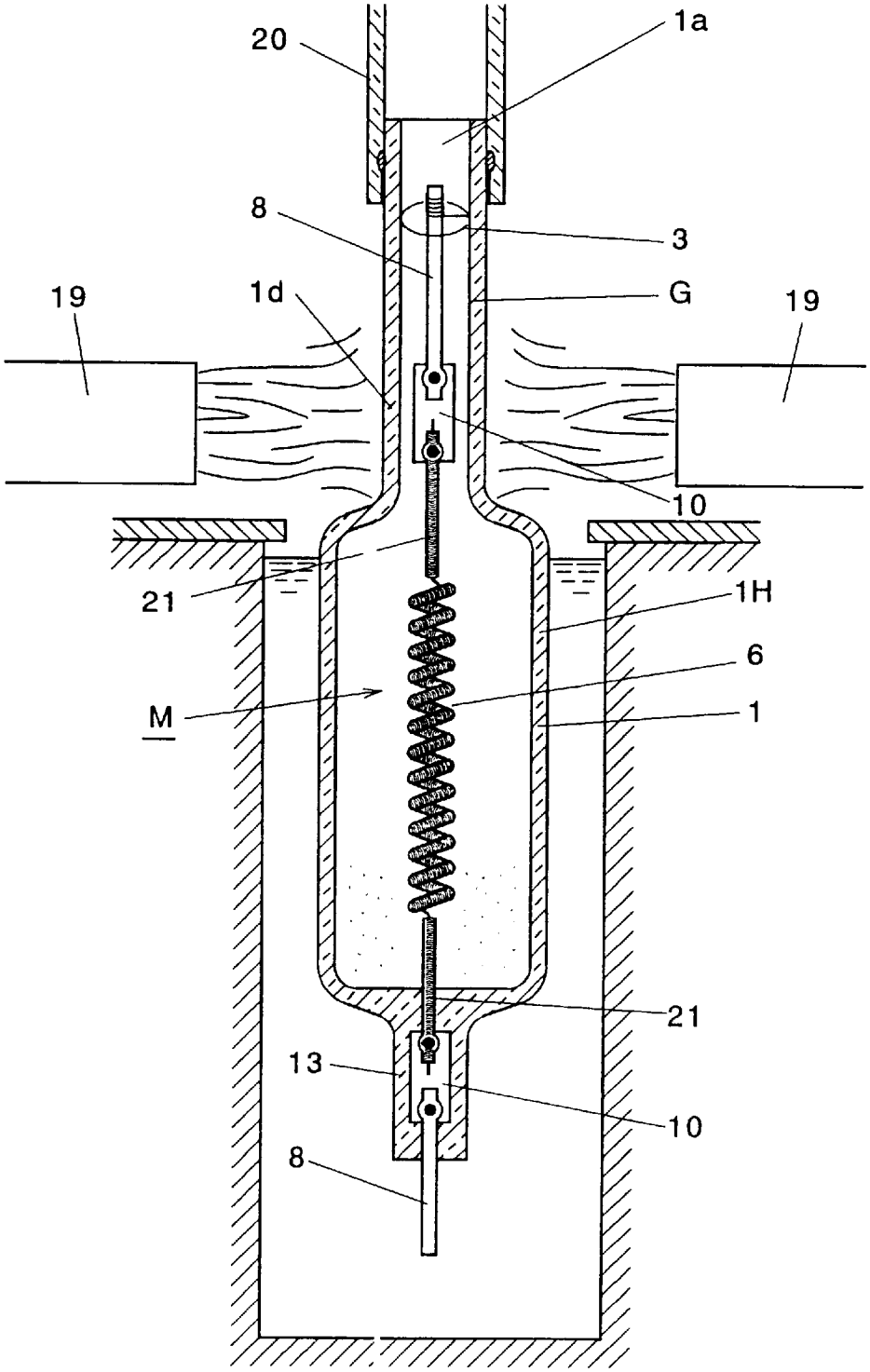
FIG. 2 is a partially-sectional elevational view illustrating one step of a method of sealing a lamp according to the present invention in which the lamp envelop shown in FIG. 1 is heated at the upper narrower open end portion while the major part thereof including the lower seal portion is cooled in liquid nitrogen.
Figure 4:
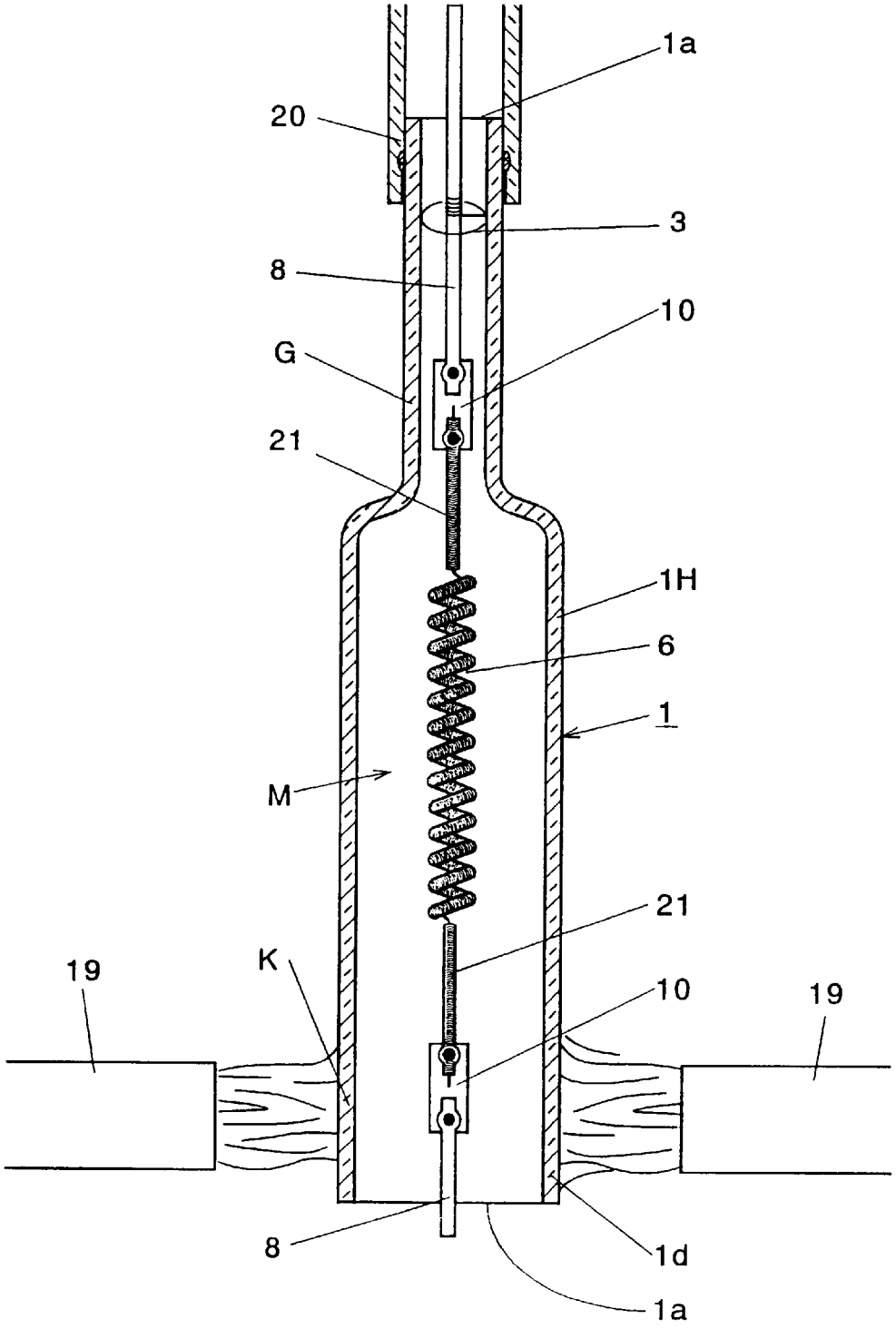
FIG. 4 is a partially-sectional elevational view illustrating one step of a method of sealing a lamp according to the present invention in which a variation of the lamp envelop having open opposite end portions is heated at the lower end portion.
Figure 5:
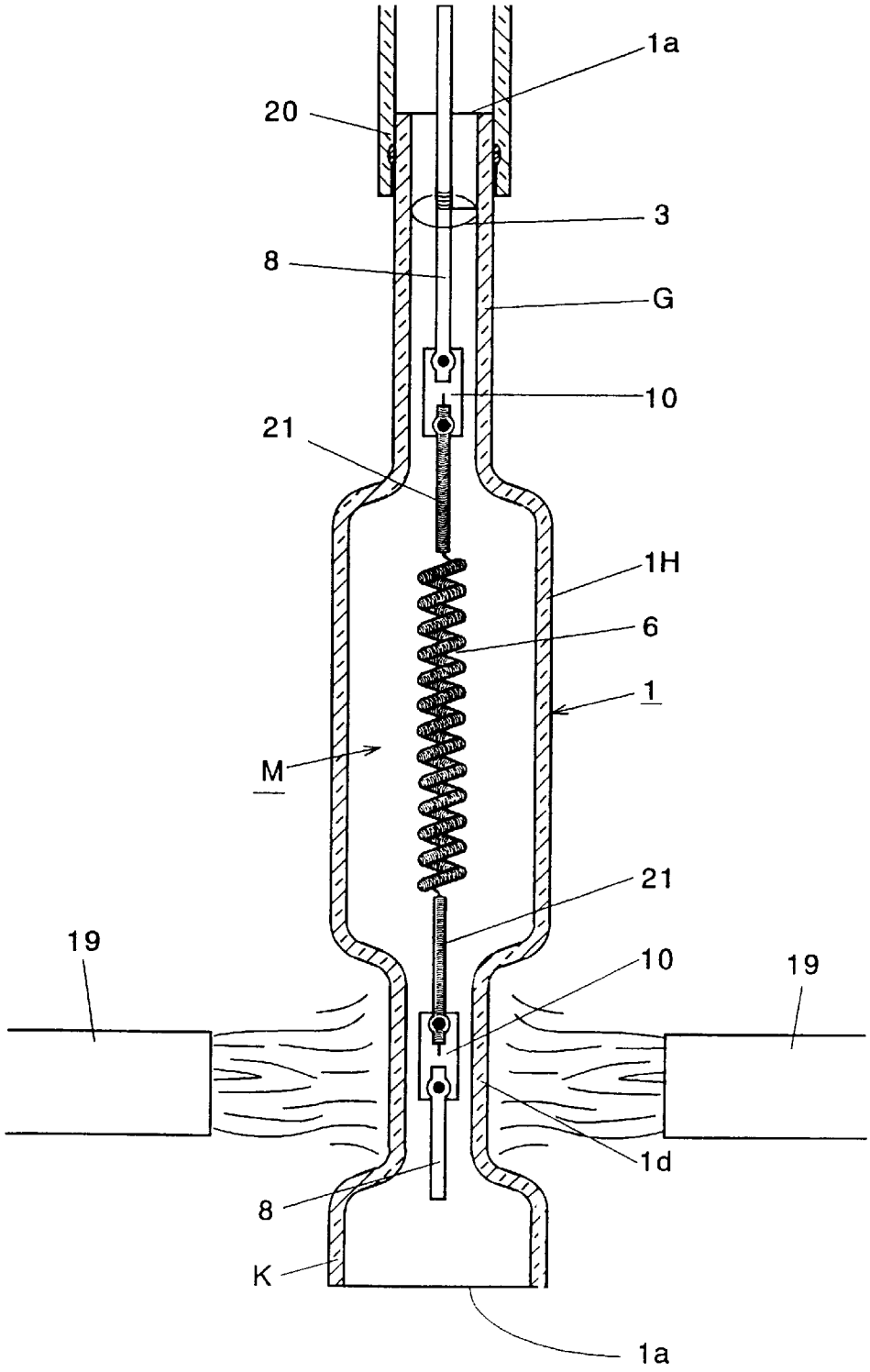
FIG. 5 is a partially-sectional elevational view illustrating one step of a method of sealing a lamp according to the present invention in which another variation of the lamp envelop having open opposite end portions is heated at the lower end portion.

Mount M is suspended within lamp envelop 1 in the following manners. Referring to FIGS. 1, 4, and 5, open end portion 1*a* on the gas-supply side of lamp envelop 1 is formed narrower than envelop body 1H, and resilient retainer 3 is wound around corresponding outer lead pin 8 so as to resiliently engage the inner periphery of the open end portion 1*a* on the gas-supply side. Although the resilient retainer 3 shown is formed of a resilient coil of thin wire, this is merely an example. Resilient retainer 3 may be of any form which can suspend mount M within lamp envelop 1 and may be attached to any position as well as to outer lead pin 8. This is true throughout the specification of the present invention.

Figure 6:
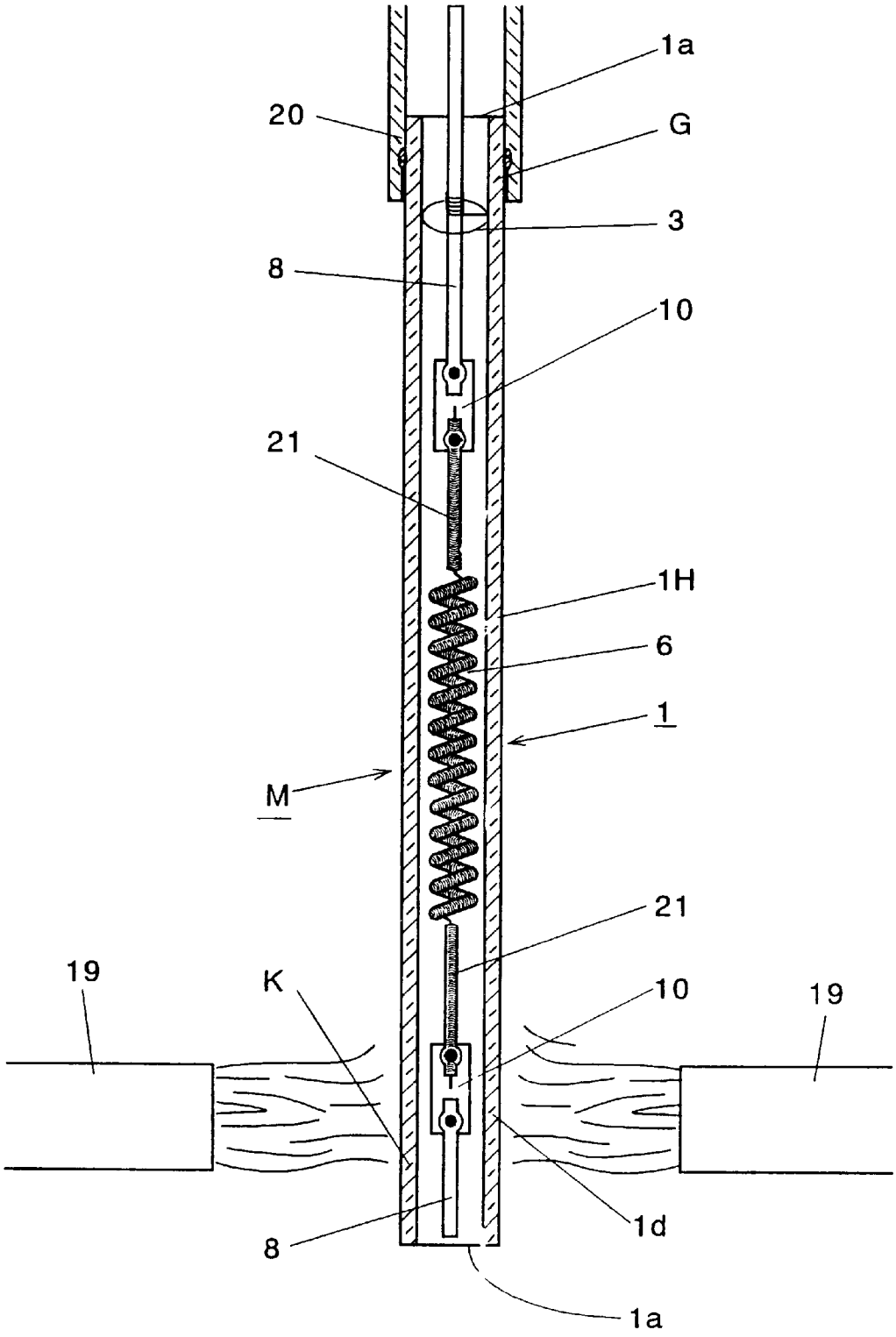
FIG. 6 is a partially-sectional elevational view illustrating one step of a method of sealing a lamp according to the present invention in which a yet another variation of the lamp envelop having open opposite end portions is heated at the lower end portion.

FIG. 6 shows the case where open end portion 1*a* is formed to have the same width as that of envelop body 1H, and resilient retainer 3 is wound around corresponding outer lead pin 8 so as to resiliently engage the inner periphery of lamp envelop 1. The resilient retainer 3 in this case is formed of a resilient coil of thin wire.

FIG. 7 shows the case where open end portion 1*a* on the mount suspending side of lamp envelop 1 comprises a narrow portion 1*a*1 to be heated and softened which is narrower than envelop body 1H and a wide portion 1*a*2 contiguous to the narrow portion 1*a*1, and resilient retainer 3 formed of a resilient thin wire of, for example, stainless steel resiliently engages the inner periphery of the wide portion 1*a*2, thereby suspending the mount M centrally of the lamp envelop 1. FIG. 11 shows the case where open end portion 1*a* on the mount suspending side of lamp envelop 1 comprises narrow portion 1*a*1 having the same width as that of envelop body 1H and wide portion 1*a*2 formed wider than envelop body 1H, and resilient retainer 3 formed of a resilient thin wire of, for example, stainless steel resiliently engages the inner periphery of the wide portion 1*a*2, thereby suspending mount M centrally of lamp envelop 1.

With the above constructions, when the narrow portion 1*a*1 is heated for sealing the open end portion on the suspending side, the existence of the wide portion 1*a*2 hinders flame of a burner from reaching gas supply tube 20, thereby protecting the gas supply tube 20 connected to the wide portion 1*a*2. As a result, the distance between the lower end of the gas supply tube 20 and the upper end of the envelop body 1H can be shortened, which leads to saving of the material cost, hence, to a decreased cost for making a lamp. This construction is particularly effective where the lamp envelop 1 is formed of quartz glass requiring a strong thermal power of the burner to be applied thereto.

The procedure of manufacturing halogen lamp A1 in accordance with one embodiment of the present invention will be described below. With regard to variations of the embodiment, only the points different from this will be explained.

Firstly, lamp envelop 1 is provided comprising envelop body 1H, opposite open end portions 1*a* each of which has a width smaller than that of the envelop body 1H as shown in FIG. 1. Then, mount M having sealing foils 10 is inserted into the lamp envelop 1 through one of the open end portions 1*a*.

As the mount M is inserted into the lamp envelop 1, resilient retainer 3 resiliently engages the inner periphery of the lamp envelop 1 to stop the mount M at an axially optimum position in the lamp envelop 1. When the axial positioning of the mount M relative to the lamp envelop 1 is thus completed, the lamp envelop 1 is typically made upright so that the open end portion 1*a* on the resilient retainer side assumes the top. Gas supply tube 20 is then connected to the upper open end portion 1*a* on the side indicated by reference character G to supply a non-oxidizing gas into the lamp envelop 1 such as an inert gas, for example, nitrogen or argon or a mixed non-oxidizing gas obtained by mixing such gas with a reducing gas such as hydrogen. Such gas is allowed flow out through the lower open end portion 1*a* on the side indicated by reference character K to keep the inside of the lamp envelop 1 in a non-oxidizing atmosphere. Subsequently, a portion of the open end portion 1*a* coinciding with lower sealing foil 10 is heated and softened.

The heated and softened portion id gradually shrinks due to its surface tension and the heat of burner flame. The shrunk portion is subjected to a slight or strong pinching to complete sealing of the lower open end portion 1*a*, and thus, seal portion 13 is provided.

Subsequent to the sealing of the lower open end portion 1*a*, a required process such as the washing of the inside of the lamp envelop 1 with a non-oxidizing gas is performed. Then, a required gas is supplied into the lamp envelop 1 from the upper open end portion 1*a*. Subsequently, while cooling the major part of the lamp envelop 1 including the seal portion 13 on the lower side optionally with liquid nitrogen, a portion of the upper open end portion 1*a* coinciding with the sealing foil 10*a* is heated and softened, and the heated portion 1*d* is similarly sealed by the above method to provide seal portion 13. After the opposite end portions are thus sealed, as required, unnecessary portions of each end portion 1*a* are cut away to provide a halogen lamp (A1) shown in FIG. 3.

Shown in FIG. 3 is a halogen lamp (A1) formed using lamp envelop 1 of another type having opposite open end portions. In the drawing, unnecessary portions having been cut away are illustrated in phantom. The halogen lamp A2 may be used with or without the unnecessary portions.

Figure 22:
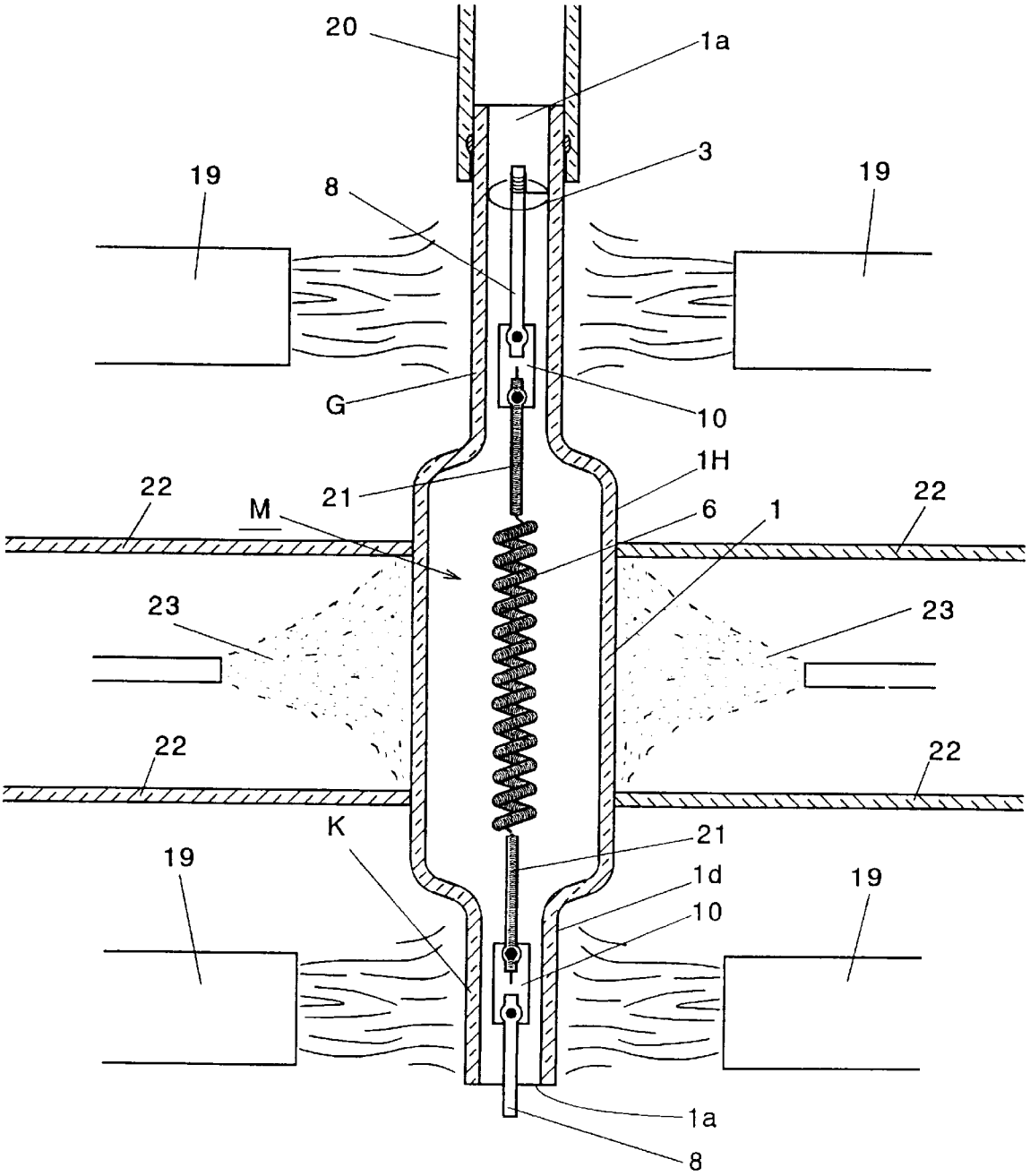
FIG. 22 is a partially-sectional elevational view illustrating one step of a method of sealing a lamp according to the present invention in which opposite open end portions of the lamp envelop are heated while the envelop body is cooled using liquid nitrogen.

Although the sealing processes of opposite end portions of the lamp envelop are successively carried out in the method described above, they can be performed simultaneously, as in the following manner. (See FIGS. 22 and 3) Referring to FIG. 22, mount M having sealing foils 10 is inserted into lamp envelop 1 through one of the open end portions until it is held at an optimum position in the lamp envelop 1 by means of resilient retainer 3. Then, the lamp envelop 1 is typically made upright so that open end portion 1*a* on the resilient retainer side assumes the top. Gas supply tube 20 is then connected to the upper open end portion 1*a* on the side indicated by the reference character G to supply a required gas into the lamp envelop 1 and allow the gas to flow through the lower open end portion 1*a* on the side indicated by the reference character K, thereby performing a required process such as washing. Subsequently, the lower open end portion 1*a* is closed with, for example, a plug (not shown). While applying liquid nitrogen 23 to the lamp envelop 1 between two shielding plates mounted in advance to the lamp envelop 1 to cool the gas within the lamp envelop thereby reducing the volume thereof, portions of the opposite open end portions 1*a* coinciding with sealing foils 10*a* are simultaneously heated and softened to form seal portions 13 in the same manner as above. After the sealing of opposite ends portions are thus completed, as required, unnecessary portions of each open end portion 1*a* are cut away to provide halogen lamp A1 shown in FIG. 3.

Figure 12:
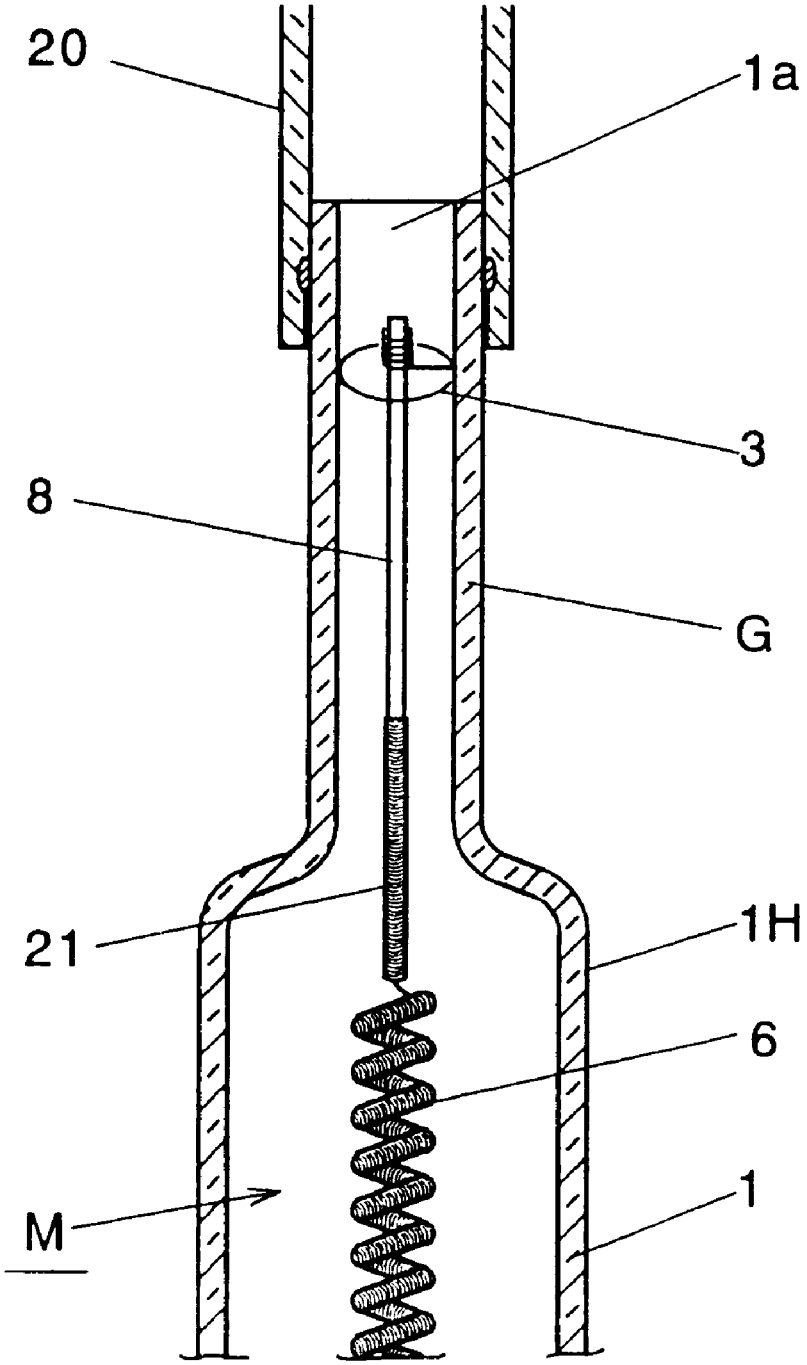
FIG. 12 is a partially-sectional fragmentary elevational view illustrating one step of a method according to the present invention in which a lamp envelop has an open end portion formed narrower than the envelop body, and a mount without a sealing foil is used.
Figure 13:
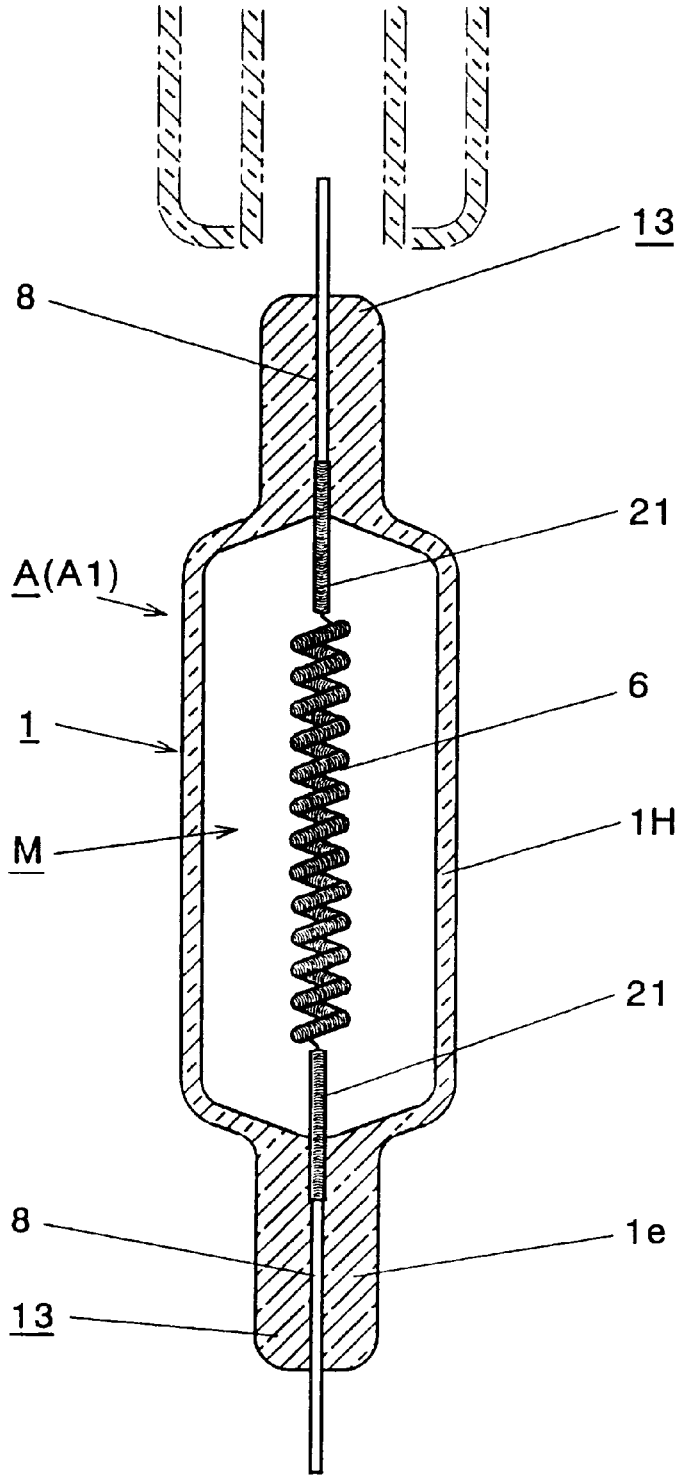
FIG. 13 is a sectional elevational view illustrating a halogen lamp of a sealing foil free type according to the present invention formed using a lamp envelop as shown in FIG. 12.

FIGS. 12 shows the case where sealing foil 10 is not used and opposite ends of filament 6 are each connected to outer lead pin 8 directly or through lead portion 21. This construction is suitable for a lamp envelop formed of hard glass. The shape and position of resilient retainer 3 and the method of positioning the resilient retainer 3 are the same as with the case of mount M including sealing foils 10. Hence, the explanation thereof is omitted.

Where the lamp envelop 1 is formed of hard glass, the connecting portion between each outer lead pin 8 and the filament 6 or the corresponding lead portion 21 is typically embedded within each seal portion 13 as shown in FIG. 13. However, each lead portion 21 formed using an inner lead pin may be extended through the corresponding seal portion 13 to protrude outwardly therefrom or each outer lead pin 8 may be extended through the corresponding seal portion 13 to correct to filament 6.

Although explanation is given to the case in which orientation of the lamp envelop 1 during sealing is vertical, the present invention is not limited thereto. That is, any orientation such as horizontal one or the like may be employed. This is also true for the case of metal halide lamps (A2).

Figures 20A, 20B, 20C, 20D:
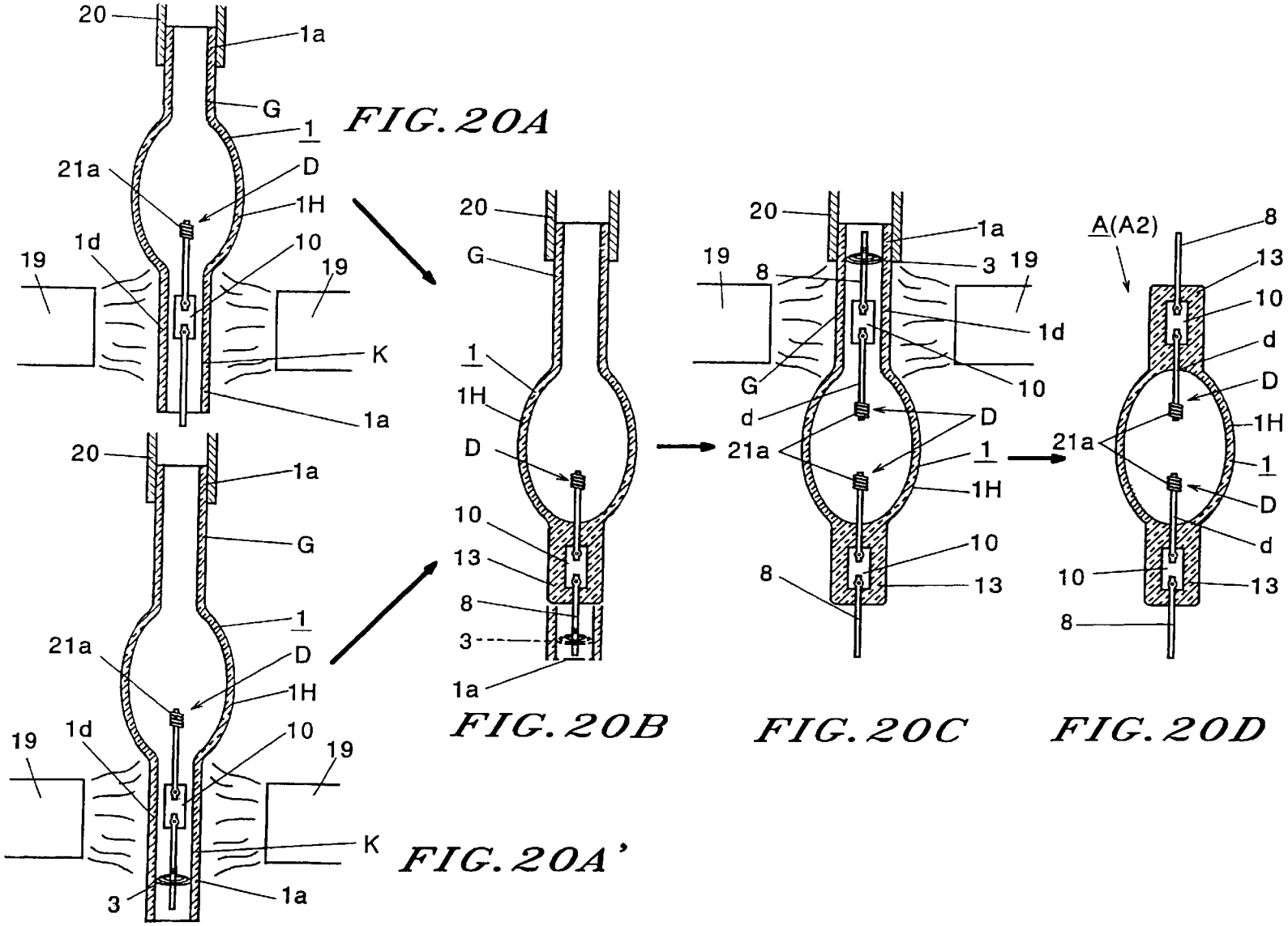
Figures 21A, 21B, 21C:
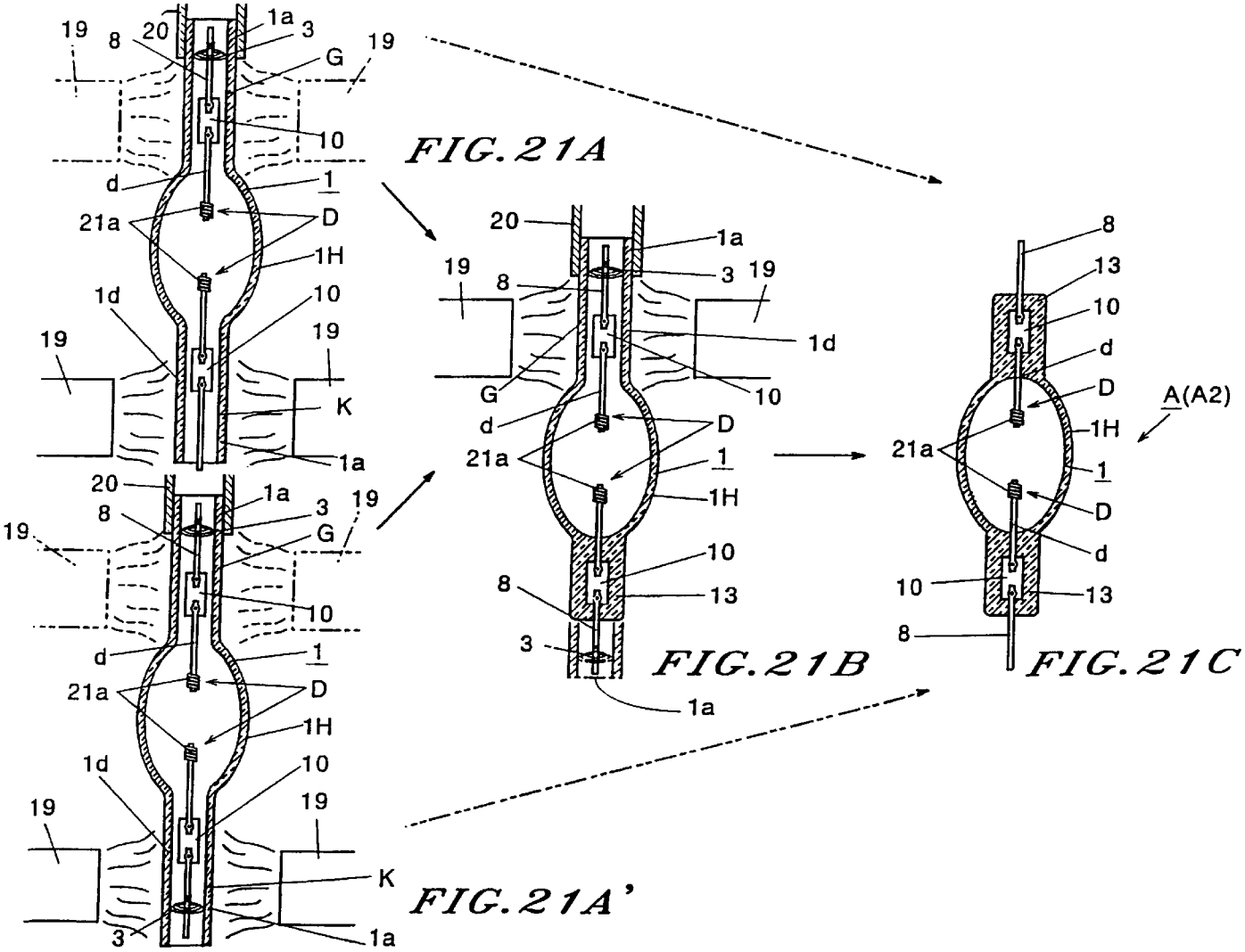

To be described next is the difference between a procedure of manufacturing metal halide lamp (A2) and that of manufacturing halogen lamp (A1). In the case of metal halide lamp (A2), a pair of discharge electrodes (D) are used instead of mount (M). Referring to FIGS. 20 and 21, each discharge electrode (D) comprises a sealing foil 10, an outer lead pin 8 connected to one end of the sealing foil 10, an electrode pin (d) connected to the other end of the sealing foil 10, and a heat dissipating portion (21*a*) wound around the electrode pin (d). The discharge electrode (D) is not limited to those described above and various types of discharge electrodes such as a sealing foil free type can also be employed.

In sealing the metal halide lamp, resilient retainer 3 may be attached to each discharge electrode, or to only one discharge electrode. The following are examples of method of sealing metal halide lamp (A2).

One example of the method follows the procedure FIGS. 20 (*a*) to 20 (*d*). Discharge electrode (D) to which resilient retainer 3 is not mounted is attached to a mount base (not shown) and inserted into lamp envelop 1 through lower open end portion 1*a* on the side designated by reference character K. Then, a non-oxidizing gas is typically fed into the lamp envelop 1 from upper open end portion 1*a* to which a gas supply tube 20 is connected, or on the side designated by reference character G to keep the inside of the lamp envelop 1 in a non-oxidizing atmosphere. In this state, a portion of the lower open end portion 1*a* coinciding with sealing foil 10 is heated by a burner 19.

The heated and softened portion 1*d* is sealed as shown in FIG. 20(*b*).

Subsequently, the gas supply tube 20 is removed from the upper open end portion 1*a*, and another discharge electrode (D) provided with resilient retainer 3 is inserted into the lamp envelop 1 through the upper open end portion 1*a* so as to be held at a desired position. After necessary operations such as washing and the following supply of a required gas are completed, a portion of the upper open end portion 1*a* coinciding with sealing foil 10 is heated by burner 19 as shown in FIG. 20(*c*).

Finally, the heated and softened portion (1*d*) is sealed, and unnecessary portions are cut away, if necessary, thus providing a lamp as shown in FIG. 20 (*d*).

A variation of this example follows the procedure FIGS. 20 (*a*') to 20 (*d*). Shown in FIG. 20 (*a*') is the case where discharge electrode (D) to be inserted through lower open end portion 1*a* is provided with resilient retainer 3. Also in this case, after the positioning of the discharge electrode (D), a non-oxidizing gas is typically fed into the lamp envelop 1 through upper open end portion 1*a* connected to gas supply tube 20. In this state, a portion of the lower open end portion 1*a* coinciding with sealing foil 10 is heated by burner 19. Since the subsequent steps are the same as those shown in FIGS. 20 (*b*) to 20 (*d*), the explanation thereof is omitted.

An alternative method of sealing a metal halide lamp follows the procedure FIGS. 21 (*a*) to 21 (*c*). Discharge electrode D to which resilient retainer 3 is not mounted is attached to a mount base (not shown) and inserted into lamp envelop 1 through a lower open end portion 1*a* on the side designated by reference character K to assume a predetermined position. At the same time, another discharge electrode (D) provided with resilient retainer 3 is inserted into the lamp envelop 1 through an upper open end portion 1*a* on the side designated by reference character G connected to a gas supply tube 20 until it is held in a predetermined position. Subsequently, a non-oxidizing gas is typically fed into the lamp envelop 1 through the upper open end portion 1*a* to keep -the inside of the lamp envelop 1 in a non-oxidizing atmosphere. In this state, a portion of the lower open end portion 1*a* coinciding with sealing foil 10 is heated by burner 19 as shown in FIG. 21 (*a*).

Then, the heated and softened portion (id) is sealed and, after necessary operations such as washing and the following supply of a required gas are completed, a portion of the open end portion coinciding with the upper sealing foil 10 is heated by burner 19 as shown in FIG. 21 (*b*).

Finally, the heated and softened portion (1*d*) is sealed and unnecessary portions are cut away, if necessary, thus providing a lamp shown in FIG. 21 (*c*).

A variation of this method follows the procedure FIGS. 21 (*a*') to 21 (*c*). Shown in FIG. 21 (*a*') is the case where opposite discharge electrodes (D) each provided with resilient retainer 3 is inserted into opposite open end portions 1*a*, respectively, of the lamp envelop 1 until each electrode is held at its predetermined position. A non-oxidizing gets is typically fed into the lamp envelop 1 through the upper open end portion 1*a* connected to gas supply tube 20 to keep the inside of the lamp envelop 1 in a non-oxidizing atmosphere. In this state, a portion of the lower open end portion 1*a* coinciding with the corresponding sealing foil 10 is heated by burner 19. Since the subsequent steps are the same as those described above, the explanation thereof is omitted.

In the case of sealing both end portions of the lamp envelop simultaneously, the procedure advances from FIG. 21 (*a*) directly to FIG. 21 (*c*) as indicated by the upper broken line arrow. Discharge electrode (D) to which resilient retainer 3 is not mounted is attached to a mount base (not shown) and inserted into a lamp envelop 1 through the lower open end portion 1*a* to assume a predetermined position. At the same time, another discharge electrode (D) provided with resilient retainer 3 is inserted into lamp envelop 1 through the upper open end portion 1*a* until it is held in a predetermined position. Subsequently, a required gas is supplied through the upper open end 1*a* into the lamp envelop 1 to perform necessary operations such as washing and allowed to flow out of the lamp envelop 1, and portions of the opposite open end portions 1*a* coinciding with respective sealing foils 10 are heated simultaneously by burner 19, while, if necessary, liquid nitrogen 23 is applied to the lamp envelop 1 between two shielding plates mounted thereto in advance. Finally, each heated and softened portion 1*d* is sealed and unnecessary portions are cut away, if necessary.

It should be noted that a lamp envelop 1 filled with mercury should be orientated horizontally during sealing, and at least discharge electrode (D) should be retained by resilient retainer 3 at at least two portions thereof.

A variation of this procedure advances from FIG. 21 (*a*') directly to FIG. 21 (*c*) as indicated by the lower broken line arrow. Firstly, opposite discharge electrodes (D) each provided with resilient retainer 3 are inserted through respective open end portions (1*a*) of the lamp envelop (1) until they are held in their predetermined positions.

Subsequently, a required gas is supplied through the upper open end 1*a* into the lamp envelop 1 to perform necessary operations such as washing and allowed to flow out of the lamp envelop 1, and portions of the opposite open end portions 1*a* coinciding with respective sealing foils 10 are heated simultaneously by burner 19, while, if necessary, liquid nitrogen 23 is applied to the lamp envelop 1 between two shielding plates mounted thereto in advance. Finally, each heated and softened portion 1*d* is sealed and unnecessary portions are cut away, if necessary.

It should be noted that a lamp envelop 1 filled with mercury should be orientated horizontally during sealing, and at least discharge electrode (D) should be retained by resilient retainer 3 at at least two portions thereof.

Similarly to the case of a halogen lamp, resilient retainer 3 of any shape can be employed, although only a ring-shaped one is shown in the drawings. Further, resilient retainer 3 may be located at any of the foregoing positions.

Figure 23:
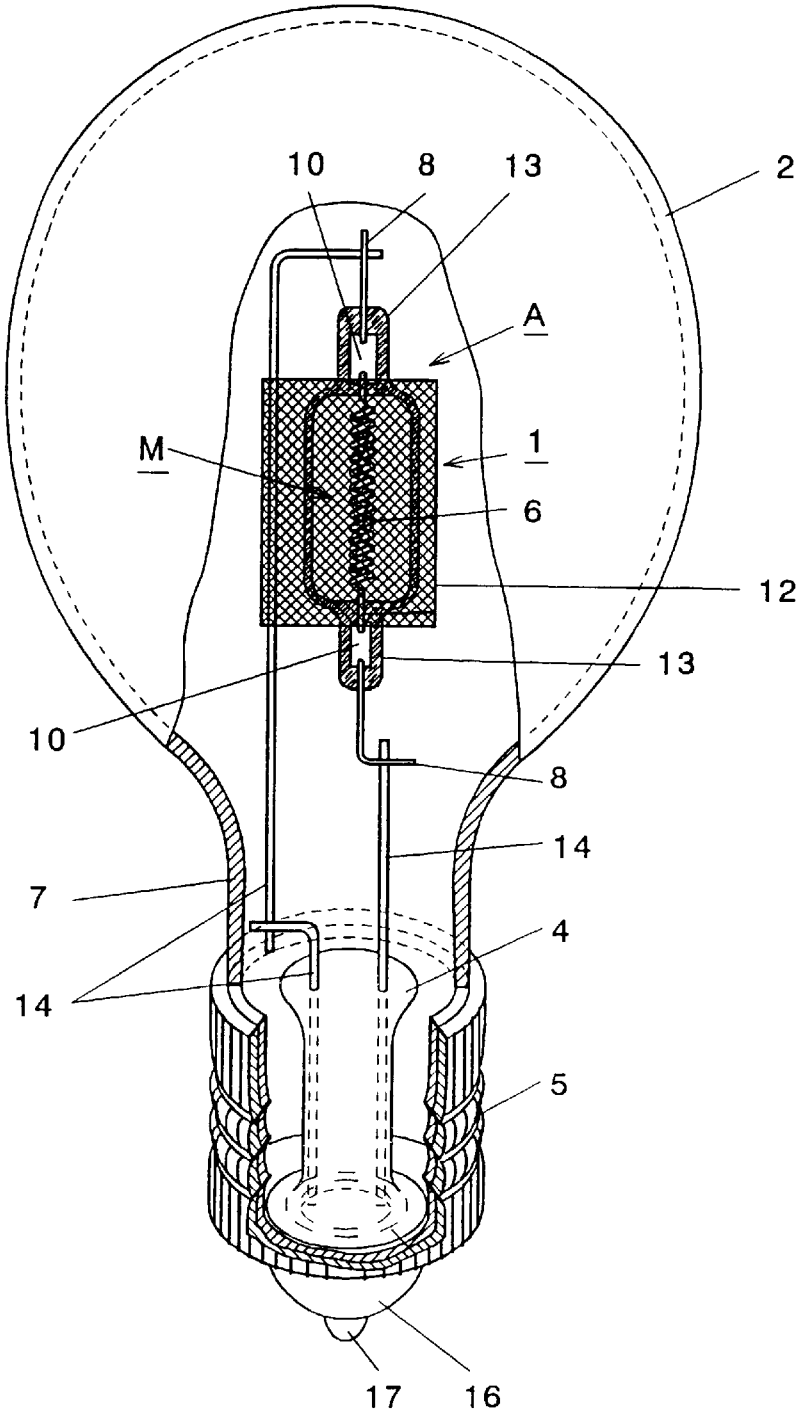
FIG. 23 is a partially cut away perspective view illustrating a double bulb type explosion-resistant lamp using a halogen lamp of a tip tube free type in accordance with the present invention.

Shown in FIG. 23 is tipless halogen lamp (A) mounted vertically in an outer bulb 2 adaptable for typical incandescent lamps. A stem 4 is disposed within a lamp base insertion portion 7 of the outer bulb 2. To the outer surface of the lamp base insertion portion 7 is bonded a threaded lamp base 5 having the same size as that of a typical eggplant-shaped incandescent lamp. A central contact 17 disposed centrally of the threaded lamp base 5 through an insulator 16 is connected to one of stem-side lead pins 14 typically through an intermediate lead-in wire, and the other of the stem-side lead pins 14 is connected to the threaded lamp base 5 typically through an intermediate lead-in wire. With this construction, the halogen lamp can be connected directly to any typical socket for conventional eggplant-shaped incandescent bulbs.

The material of outer bulb 2 may be glass or a resin, and may be transparent or translucent like ground glass. The state of the outer surface of the bulb can be selected as desired. Further, the outer bulb may assume various forms as well as a typical eggplant shape.

The atmosphere within the outer bulb 2 is not limited to any particular one, and may be a non-oxidizing atmosphere or air. Increased or reduced pressure may be provided in the outer bulb 2.

Further, an explosion resistant member 12 may be disposed to surround the halogen lamp A. The explosion resistant member 12 may be, for example, a cylindrical netting formed by knitting thin wires, or punched metal or lath formed into a cylindrical configuration. The explosion resistant member 12 is directly or indirectly attached to one of the lead pins 14.

With this construction, the explosion resistant member 12 prevents fragments of the halogen lamp from scattering even when the halogen lamp (A1) serving as the inner bulb explodes by any reason, and hence, a secondary accident due to such explosion can be avoided.

Figure 24:
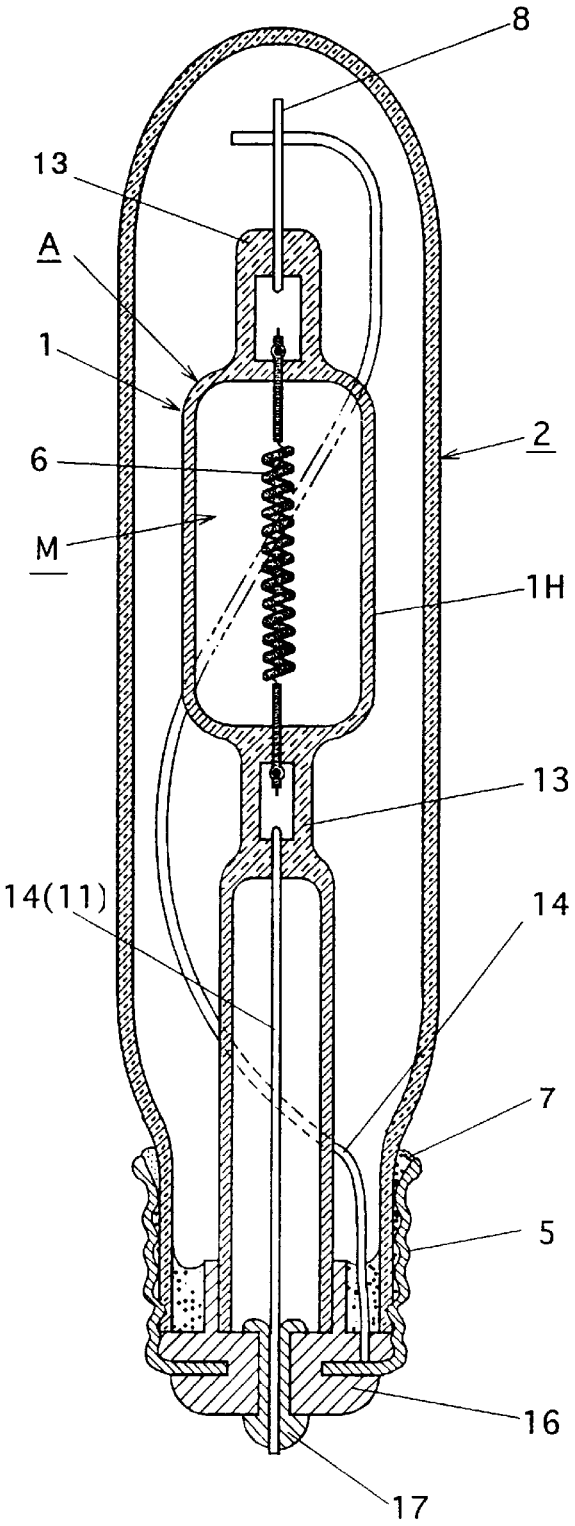
FIG. 24 is a partially-sectional elevational view illustrating an elongated lamp of a double bulb type using a halogen lamp of a tip tube free type in accordance with the present invention.
Figure 25:
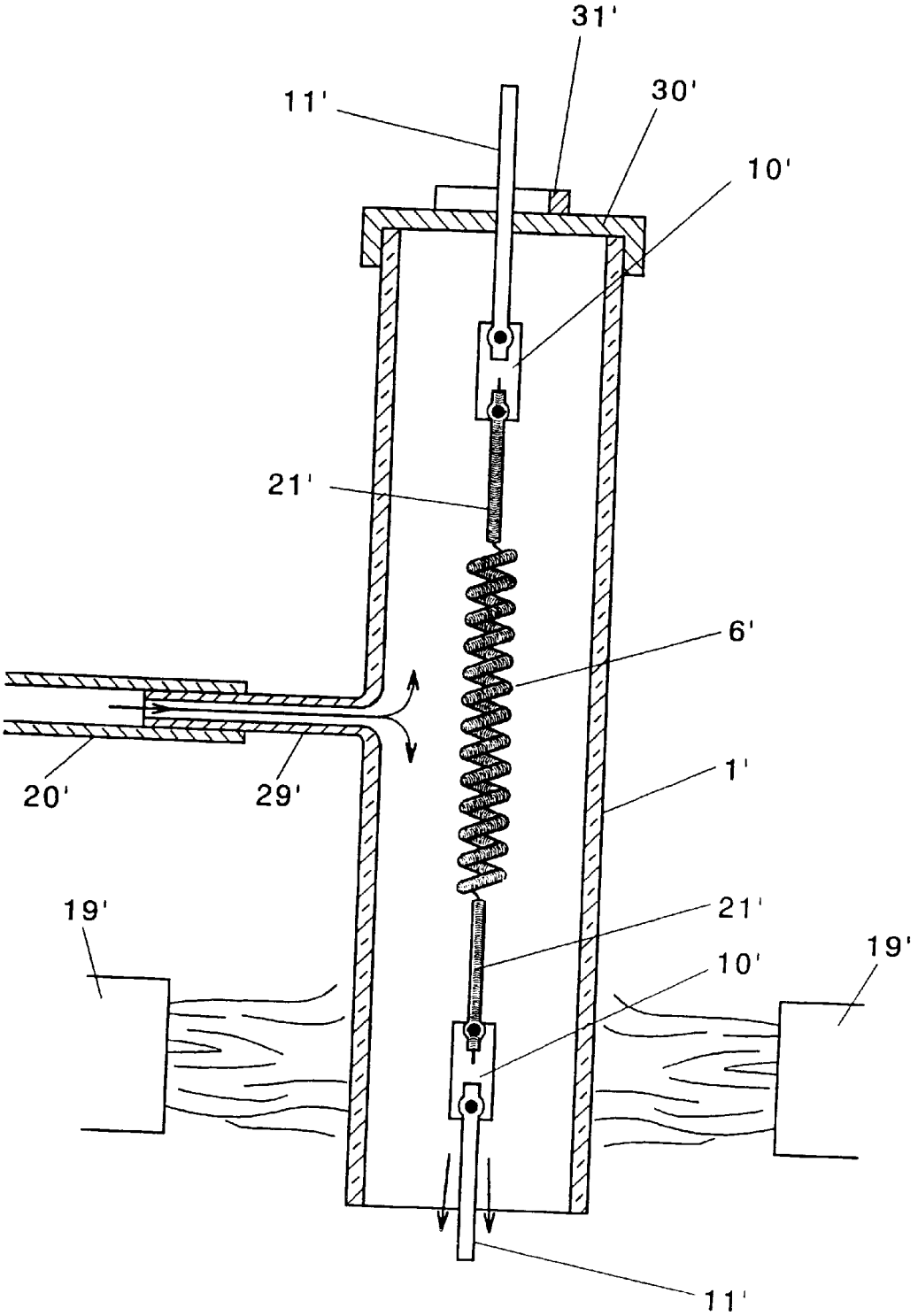
Fig.25 (PRIOR ART)
FIG. 25 is a partially-sectional elevational view illustrating one step of a conventional lamp manufacturing process.
Figure 26:
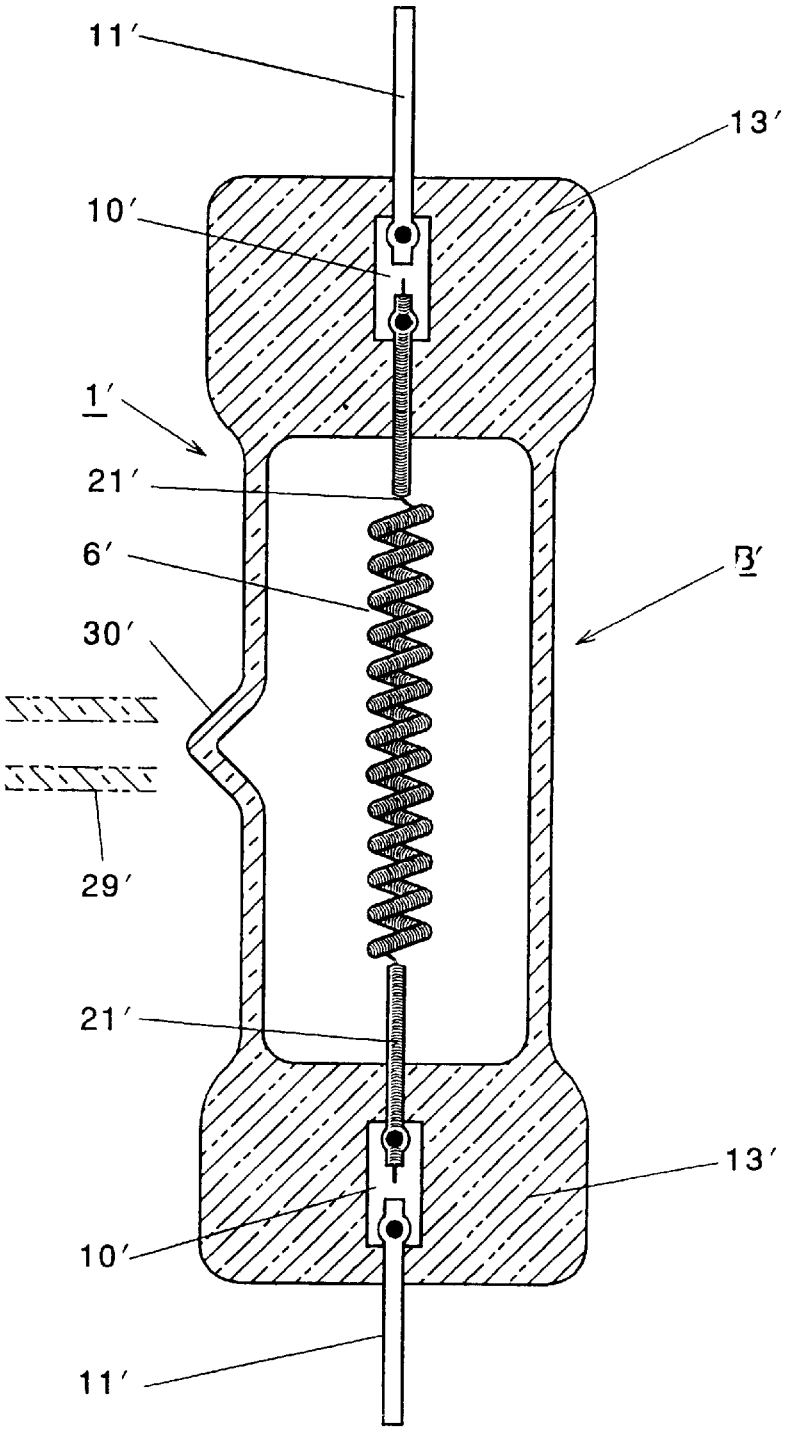
Fig.26 (PRIOR ART)
FIG. 26 is a partially-sectional elevational view illustrating a conventional halogen lamp.

FIG. 24 shows the case where the double ended type halogen lamp (A1) without cutting unnecessary portions is housed in an elongate outer bulb 2.

As has been described, since the lamp envelop is free of the cutting trace of a tip tube, explosion of the lamp envelop, which would be conventionally caused by an internal strain due to such cutting trace, can be avoided. Accordingly, it is possible to considerably increase the filling gas pressure in the lamp envelop, thereby retarding the evaporation of tungsten forming the filament or the discharge electrodes. Thus, halogen lamps exhibiting enhanced performance can be realized.

Where the open end portions of lamp envelop has a portion wider than the rest, the existence of the wide portion can hinder burner flame from reaching the gas supply tube. As a result, the gas supply tube can be protected, and the distance between the lower end of the gas supply tube and the upper end of the envelop body can be shortened, which leads to a decreased cost of making a lamp.

Further, by virtue of the provision of the resilient retainer, the mount can be suspended at any desired position within the lamp envelop. That is, the resilient retainer not only facilitates the axial positioning of the mount relative to the lamp envelop but also enables the compulsory positioning of one end of the mount on the central axis of one open end portion of the lamp envelop, whereby the mount can be substantially centered relative to the lamp envelop.

While only certain presently preferred embodiments of the invention have been described in detail, as will be apparent with those skilled in the art, certain changes and modifications can be made in embodiments without departing from the spirit and scope of the invention as defined in the following claims.

What is claimed is:

1. A method of sealing a lamp comprising the steps of:

providing a lamp envelop having an envelop body, and first and second end portions which are open;

inserting a mount including a filament and a resilient retainer into the lamp envelop through one of the open end portions until the mount is retained within the lamp envelop by the resilient retainer;

heating the first open end portion of the lamp envelop to soften and shrink and then optionally pinching the heated portion thereby sealing the first open end portion with one end of the mount embedded therein; and heating the second open end portion of the lamp envelop to soften and shrink and then optionally pinching the heated portion thereby sealing the second open end portion with an opposite end of the mount embedded therein;

wherein at least one of the first and second open end portions of the lamp envelop comprises a narrow portion which is equal to or smaller in width than the narrow portion and is formed contiguous to the narrow portion, the narrow portion being intended to be heated to form a seal portion.

2. A method of sealing a lamp comprising the steps of:

providing a lamp envelop having an envelop body, and first and second end portions which are open;

inserting a mount including a filament and a resilient retainer into the lamp envelop through one of the open end portions until the mount is retained within the lamp envelop by the resilient retainer; and heating simultaneously the first and second open end portions of the lamp envelop to soften and shrink and then optionally pinching the heated portions thereby simultaneously sealing the first and second open end portions with opposite ends of the mount embedded in the first and second end portions, respectively.

3. A method of sealing a lamp comprising the steps of:

providing a lamp envelop having an envelop body, and first and second end portions which are open;

inserting a first discharge electrode into the lamp envelop through the first open end portion and retaining the first discharge electrode within the lamp envelop;

heating the first open end portion of the lamp envelop to soften and shrink and then optionally pinching the heated portion thereby sealing the first open end portion with a portion of the first discharge electrode embedded therein;

inserting a second discharge electrode into the lamp envelop through the second open end portion and retaining the second discharge electrode within the lamp envelop; and heating the second open end portion of the lamp envelop to soften and shrink and then optionally pinching the heated portion thereby sealing the second open end portion with a portion of the second discharge electrode embedded therein;

at least one of the first and second discharge electrodes being provided with a resilient retainer for retaining the corresponding discharge electrode within the lamp envelop;

wherein, at least one of the first and second open end portions of the lamp envelop comprises a narrow portion which is equal to or smaller in width than the envelop body, and a wide portion which is wider than the narrow portion and is formed contiguous to the narrow portion, the narrow portion being intended to be heated to form a seal portion.

4. A method of sealing a lamp comprising the steps of:

providing a lamp envelop having an envelop body, and first and second end portions which are open;

inserting first and second discharge electrodes at least one of which is provided with a resilient retainer into the lamp envelop through the first and second open end portions, respectively, and retaining the first and second discharge electrodes within the lamp envelop;

heating the first open end portion of the lamp envelop to soften and shrink and then optionally pinching the heated portion thereby sealing the first open end portion with a portion of the first discharge electrode embedded therein; and heating the second open end portion of the lamp envelop to soften and shrink and then optionally pinching the heated portion thereby sealing the second open end portion with a portion of the second discharge electrode embedded therein;

wherein at least one of the first and second open end portions of the lamp envelop comprises a narrow portion which is equal to or smaller in width than the envelop body, and a wide portion which is wider than the narrow portion and is formed contiguous to the narrow portion, the narrow portion being intended to be heated to form a seal portion.

5. A method of sealing a lamp comprising the steps of:

providing a lamp envelop having an envelop body, and first and second end portions which are open;

inserting first and second discharge electrodes at least one of which is provided with a resilient retainer into the lamp envelop through the first and second open end portions, respectively, and retaining the first and second discharge electrodes within the lamp envelop; and heating simultaneously the first and second open end portions of the lamp envelop to soften and shrink and then optionally pinching the heated portions thereby simultaneously sealing the first and second open end portions with the first and second discharge electrodes partially embedded in the first and second end portions thus sealed, respectively.

6. The method as set forth in claim 1, wherein: the mount is inserted into the lamp envelop in such a manner that the opposite ends of the mount are positioned in the first and second end portions, respectively, of the lamp envelop.

7. The method as set forth in claim 2, wherein: at least one of the first and second open end portions of the lamp envelop is narrower than the envelop body and the mount is inserted into the lamp envelop in such a manner that the opposite ends of the mount are positioned in the first and second end portions, respectively, of the lamp envelop.

8. The method as set forth in claim 3, wherein: the first and second discharge electrodes are inserted into the lamp envelop in such a manner that outer ends of the first and second discharge electrodes are positioned in the first and second end portions, respectively, of the lamp envelop.

9. The method as set forth in claim 4, wherein: the first and second discharge electrodes are inserted into the lamp envelop in such a manner that outer ends of the first and second discharge electrodes are positioned in the first and second end portions, respectively, of the lamp envelop.

10. The method as set forth in claim 5, wherein: at least one of the first and second open end portions of the lamp envelop is narrower than the envelop body and the first and second discharge electrodes are inserted into the lamp envelop in such a manner that outer ends of the first and second discharge electrodes are positioned in the first and second end portions, respectively, of the lamp envelop.

11. The method as set forth in claim 2, wherein: at least one of the first and second open end portions of the lamp envelop comprises a narrow portion which is equal to or smaller in width than the envelop body, and a wide portion which is wider than the narrow portion and is formed contiguous to the narrow portion, the narrow portion being intended to be heated to form a seal portion.

12. The method as set forth in claim 5, wherein: at least one of the first and second open end portions of the lamp envelop comprises a narrow portion which is equal to or smaller in width than the envelop body, and a wide portion which is wider than the narrow portion and is formed contiguous to the narrow portion, the narrow portion being intended to be heated to form a seal portion.

* * * * *